US009360792B2

(12) United States Patent
Murakami et al.

(10) Patent No.: US 9,360,792 B2
(45) Date of Patent: Jun. 7, 2016

(54) OPTICAL WRITING CONTROLLER, IMAGE FORMING APPARATUS, AND OPTICAL WRITING CONTROL METHOD

(71) Applicants: Masatoshi Murakami, Osaka (JP); Masayuki Hayashi, Osaka (JP); Motohiro Kawanabe, Osaka (JP); Yoshinori Shirasaki, Osaka (JP); Yuusuke Kohri, Osaka (JP); Akinori Yamaguchi, Osaka (JP)

(72) Inventors: Masatoshi Murakami, Osaka (JP); Masayuki Hayashi, Osaka (JP); Motohiro Kawanabe, Osaka (JP); Yoshinori Shirasaki, Osaka (JP); Yuusuke Kohri, Osaka (JP); Akinori Yamaguchi, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/657,444

(22) Filed: Mar. 13, 2015

(65) Prior Publication Data

US 2015/0261118 A1 Sep. 17, 2015

(30) Foreign Application Priority Data

Mar. 17, 2014 (JP) ..... 2014-053899

(51) Int. Cl.
*G03G 15/043* (2006.01)

(52) U.S. Cl.
CPC ..... *G03G 15/043* (2013.01)

(58) Field of Classification Search
CPC ..... G03G 15/043; B41J 2/385
See application file for complete search history.

(56) References Cited

U.S. PATENT DOCUMENTS

2005/0117133 A1* 6/2005 Ishikawa ..... B41J 2/45 355/18
2014/0152754 A1* 6/2014 Murakami ..... G03G 15/5058 347/116
2015/0139702 A1* 5/2015 Murakami ..... G03G 15/5041 399/301

FOREIGN PATENT DOCUMENTS

| | | | |
|---|---|---|---|
| JP | 2005-96112 | | 4/2005 |
| JP | 2005096112 | A * | 4/2005 |
| JP | 2005-131864 | | 5/2005 |
| JP | 2008284760 | A * | 11/2008 |
| JP | 2014-109719 | | 6/2014 |
| JP | 2014-167516 | | 9/2014 |
| JP | 2015-055784 | A | 3/2015 |
| JP | 2015-059996 | A | 3/2015 |
| JP | 2015055784 | A * | 3/2015 |
| JP | 2015-099192 | A | 5/2015 |

* cited by examiner

*Primary Examiner* — Sarah Al Hashimi
(74) *Attorney, Agent, or Firm* — Harness, Dickey & Pierce, P.L.C.

(57) ABSTRACT

An optical writing controller controls emission of a light source device including multiple light emitting element rows each constituted by multiple light emitting elements arranged in a sub-scanning direction to form an electrostatic latent image on a photoconductor. The optical writing controller includes an image information acquisition unit to acquire image information on an image to be formed as the electrostatic latent image; a light source control unit to sequentially control emission of the multiple light emitting elements on the basis of information on pixels generated on the basis of the acquired image information; an error information acquisition unit to acquire information indicating an error of a direction in which the light emitting elements are arranged with respect to the sub-scanning direction; and an adjustment value generation unit to generate an adjustment value for adjusting a light quantity of each light emitting element on the basis of the error.

10 Claims, 16 Drawing Sheets

FIG.19A

| ELEMENT NUMBER | ELEMENT MISALIGNMENT AMOUNT | CHIP MISALIGNMENT AMOUNT | ENTIRE MISALIGNMENT AMOUNT |
|---|---|---|---|
| #1-1 | $X_{11}$, $Y_{11}$ | $X_{\#1}$, $Y_{\#1}$ $\theta_{\#1}$ | $X_0$, $Y_0$ $\theta_0$ |
| #1-2 | $X_{12}$, $Y_{12}$ | | |
| #1-3 | $X_{13}$, $Y_{13}$ | | |
| #1-4 | $X_{14}$, $Y_{14}$ | | |
| ... | | | |
| #2-1 | $X_{21}$, $Y_{21}$ | $X_{\#2}$, $Y_{\#2}$ $\theta_{\#2}$ | |
| #2-2 | $X_{22}$, $Y_{22}$ | | |
| #2-3 | $X_{23}$, $Y_{23}$ | | |
| #2-4 | $X_{24}$, $Y_{24}$ | | |
| ... | | | |

FIG.19B

| ELEMENT NUMBER | REFERENCE LIGHT QUANTITY | ARRAY AVERAGE LIGHT QUANTITY | ENTIRE AVERAGE LIGHT QUANTITY |
|---|---|---|---|
| #1-1 | xx | xx | xx |
| #1-2 | xx | | |
| #1-3 | xx | | |
| #1-4 | xx | | |
| ... | | | |
| #2-1 | xx | xx | |
| #2-2 | xx | | |
| #2-3 | xx | | |
| #2-4 | xx | | |
| ... | | | |

| IN-ROW NUMBER | $X_{peak1}$ $Y_{peak1}$ | $X_{peak2}$ $Y_{peak2}$ | $X_{peak3}$ $Y_{peak3}$ | |
|---|---|---|---|---|
| 1 | xxx | xxx | xxx | |
| 2 | xxx | xxx | xxx | |
| 3 | xxx | xxx | xxx | ... |
| 4 | xxx | xxx | xxx | |
| 5 | xxx | xxx | xxx | |
| 6 | xxx | xxx | xxx | |

OPTICAL WRITING CONTROLLER, IMAGE FORMING APPARATUS, AND OPTICAL WRITING CONTROL METHOD

CROSS-REFERENCE TO RELATED APPLICATIONS

The present application claims priority to and incorporates by reference the entire contents of Japanese Patent Application No. 2014-053899 filed in Japan on Mar. 17, 2014.

BACKGROUND OF THE INVENTION

1. Field of the Invention

The present invention relates to an optical writing controller, an image forming apparatus, and an optical writing control method.

2. Description of the Related Art

In recent years, computerization of information tends to be advanced, and image processing apparatuses such as printers and facsimile machines used for outputting computerized information and scanners used for computerization of documents have become essential equipment. Such an image processing apparatus is often a multifunction peripheral having an imaging function, an image forming function, a communication function, etc., and thus being capable of being used as a printer, a facsimile machine, a scanner, and a copier.

Among such image processing apparatuses, electrophotographic imaging forming apparatuses are widely used as image forming apparatuses used for outputting computerized documents. In an electrophotographic image forming apparatus, a photoconductor is exposed to form an electrostatic latent image, a developer such as toner is used to develop the electrostatic latent image and form a toner image, and the toner image is transferred onto a sheet of paper for output.

In such an electrophotographic image forming apparatus, a linear light source such as an LED array (LEDA) in which light emitting diode (LED) elements are arranged in a main-scanning direction may be used as a light source for exposing the photoconductor. In addition, a method of arranging multiple LED elements not only in the main-scanning direction but also in a sub-scanning direction so as to increase the exposure amount and the pixel density has been proposed (refer, for example, to Japanese Laid-open Patent Publication No. 2005-096112).

When multiple LED elements are also arranged in the sub-scanning direction, the respective LED elements arranged in the sub-scanning direction are sequentially lit with conveyance of the photoconductor surface so that the same position in the main-scanning direction of the photoconductor is exposed a plurality of times, and exposure energy can thus be increased. Thus, the light emitting elements are not limited to LED elements, and light emitting elements having a lower light quantity may be used.

An attachment error of the light emitting elements, however, may cause misalignment between the direction in which the multiple light emitting elements are arranged and the sub-scanning direction of the photoconductor drum. In such a case, the positions on the photoconductor exposed by the respective light emitting elements arranged to expose the same position in the main-scanning direction are gradually slightly changed, and the region on the photoconductor exposed by one row of light emitting elements becomes wider in the main-scanning direction. This results in uneven density in the formed image.

Such a problem of uneven density caused by the attachment error of the light emitting elements is not considered in Japanese Laid-open Patent Publication No. 2005-096112.

Therefore, there is a need to prevent deterioration in image quality due to attachment error of light emitting elements when a light source in which multiple light emitting elements are arranged in the sub-scanning direction is used for an optical writing device for forming an electrostatic latent image.

SUMMARY OF THE INVENTION

It is an object of the present invention to at least partially solve the problems in the conventional technology.

According to an embodiment, an optical writing controller controls emission of a light source device including multiple light emitting element rows each constituted by multiple light emitting elements arranged in a sub-scanning direction to form an electrostatic latent image on a photoconductor. The optical writing controller includes an image information acquisition unit, a light source control unit, an error information acquisition unit, and an adjustment value generation unit. The image information acquisition unit is configured to acquire image information that is information on an image to be formed as the electrostatic latent image. The light source control unit is configured to sequentially control emission of the multiple light emitting elements arranged in the sub-scanning direction on the basis of information on pixels generated on the basis of the acquired image information. The error information acquisition unit is configured to acquire information indicating an error of a direction in which the light emitting elements are arranged with respect to the sub-scanning direction. The adjustment value generation unit is configured to generate an adjustment value for adjusting a light quantity of each of the light emitting elements on the basis of the error of the direction in which the light emitting elements are arranged with respect to the sub-scanning direction.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIGS. 19A and 19B are tables illustrating information stored in a correction data storage unit according to the embodiment of the present invention;

DETAILED DESCRIPTION OF THE PREFERRED EMBODIMENTS

An embodiment of the present invention will be described in detail below with reference to the drawings. In the present embodiment, an image forming apparatus that is a multifunction peripheral (MFP) will be described as an example. The image forming apparatus according to the present embodiment is an electrophotographic image forming apparatus, and uses a linear light source in which light emitting elements are arranged in the main-scanning direction and multiple light emitting elements are also arranged in the sub-scanning direction as a light source for exposing a photoconductor.

The multiple light emitting elements arranged in the sub-scanning direction in this manner are sequentially lit with conveyance of the photoconductor so that the same position in the main-scanning direction on the photoconductor is exposed a plurality of times, and exposure energy can thus be increased. With such a configuration, a main feature of the present embodiment is to prevent deterioration in image quality due to attachment error of the light emitting elements by adjusting the light quantity of each of the light emitting elements arranged in the sub-scanning direction.

Figure 1:
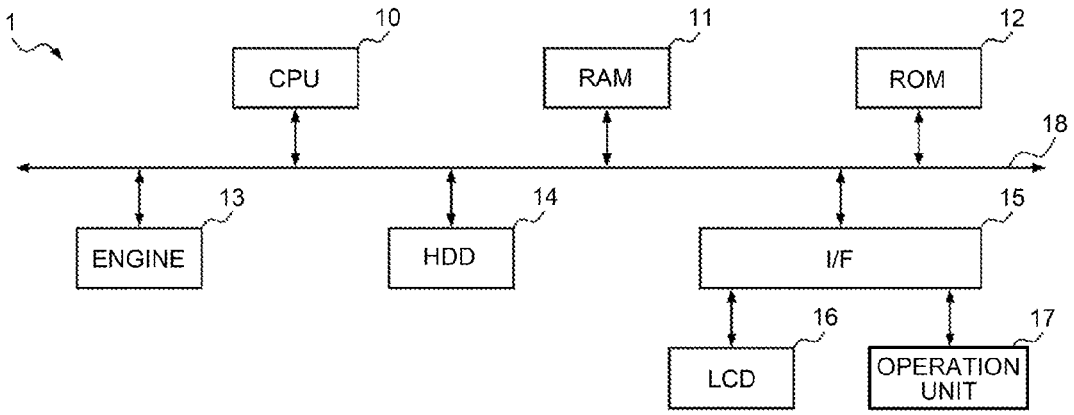
FIG. 1 is a block diagram illustrating a hardware configuration of an image forming apparatus according to an embodiment of the present invention.

FIG. 1 is a block diagram illustrating a hardware configuration of an image forming apparatus 1 according to the present embodiment. As illustrated in FIG. 1, the image forming apparatus 1 according to the present embodiment includes an engine configured to carry out image formation in addition to a configuration similar to that of a common server or an information processing terminal such as a personal computer (PC). Specifically, the image forming apparatus 1 according to the present embodiment includes a central processing unit (CPU) 10, a random access memory (RAM) 11, a read only memory (ROM) 12, an engine 13, a hard disk drive (HDD) 14, and an interface (I/F) 15, which are connected via a bus 18. In addition, a liquid crystal display (LCD) 16 and an operation unit 17 are connected to the I/F 15.

The CPU 10 is computing means that controls operation of the entire image forming apparatus 1. The RAM 11 is a volatile storage medium capable of reading and writing information at high speeds, and is used as a working area for the CPU 10 to process information. The ROM 12 is a read-only non-volatile storage medium and stores programs such as firmware. The engine 13 is a mechanism for actually carrying out image formation in the image forming apparatus 1.

The HDD 14 is a non-volatile storage medium from/into which information can be read and written, and stores an operating system (OS), various control programs, application programs, etc. The I/F 15 connects and controls the bus 18 and various hardware and networks. The LCD 16 is a visual user interface for the user to check the state of the image forming apparatus 1. The operation unit 17 is a user interface such as a keyboard and a mouse for the user to input information to the image forming apparatus 1.

With such a hardware configuration, the CPU 10 performs computation according to programs stored in the ROM 12 and programs read out from the HDD 14 or a recording medium such as an optical disk, which is not illustrated, onto the RAM 11 to form software control units. Functional blocks realizing the functions of the image forming apparatus 1 according to the present embodiment are implemented by combination of the thus formed software control units and hardware.

Figure 2:
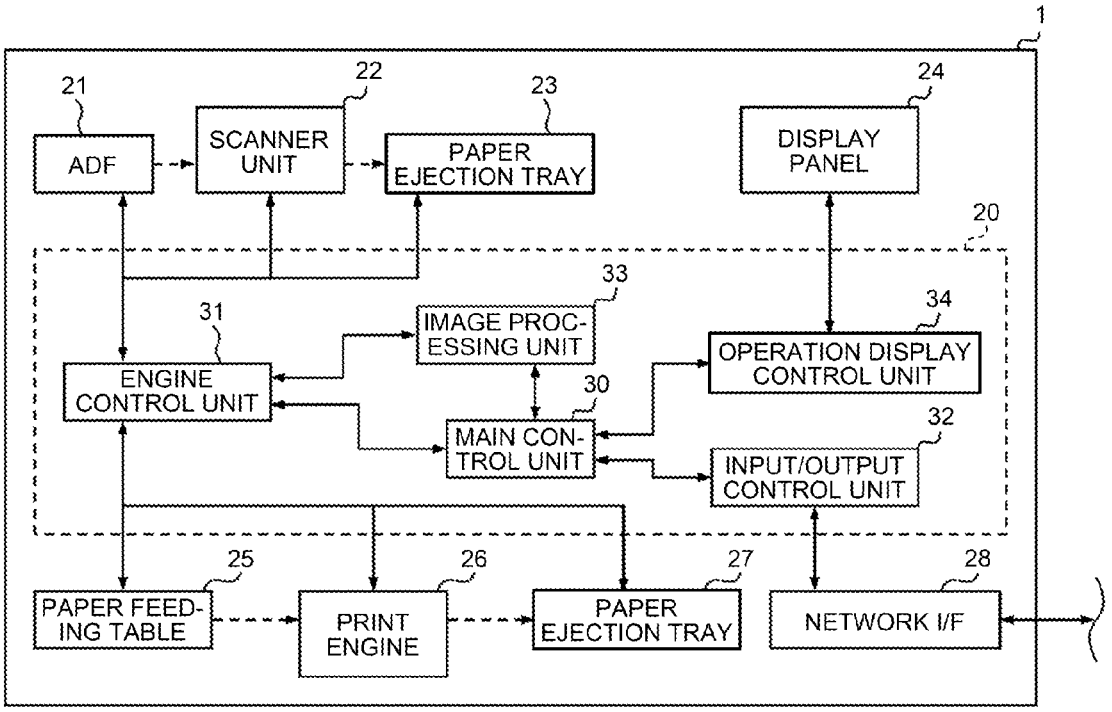
FIG. 2 is a diagram illustrating a functional configuration of the image forming apparatus according to the embodiment of the present invention.

Next, a functional configuration of the image forming apparatus 1 according to the present embodiment will be described with reference to FIG. 2. FIG. 2 is a block diagram illustrating the functional configuration of the image forming apparatus 1 according to the present embodiment. As illustrated in FIG. 2, the image forming apparatus 1 according to the present embodiment includes a controller 20, an automatic document feeder (ADF) 21, a scanner unit 22, a paper ejection tray 23, a display panel 24, a paper feeding table 25, a print engine 26, a paper ejection tray 27, and a network I/F 28.

The controller 20 includes a main control unit 30, an engine control unit 31, an input/output control unit 32, an image processing unit 33, and an operation display control unit 34. As illustrated in FIG. 2, the image forming apparatus 1 according to the present embodiment is a multifunction peripheral including the scanner unit 22 and the print engine 26. Note that, in FIG. 2, electric connections are indicated by solid arrows and the flow of sheets is indicated by broken arrows.

The display panel 24 in an output interface that visually displays the state of the image forming apparatus 1, and also an input interface (operation unit) in the form of a touch panel for the user to directly operate the image forming apparatus 1 or input information to the image forming apparatus 1. The network I/F 28 is an interface for the image forming apparatus 1 to communicate with other devices via a network, and an Ethernet (registered trademark) or a universal serial bus (USB) interface is used therefor.

The controller 20 is implemented by combination of software and hardware. Specifically, as described above, the controller 20 is implemented by combination of the software control units formed by computation of the CPU 10 and hardware such as integrated circuits. The controller 20 functions as a control unit that controls the entire image forming apparatus 1.

The main control unit 30 serves to control respective components included in the controller 20, and gives instructions to the respective components of the controller 20. The engine control unit 31 serves as drive means that controls or drives the print engine 26 and the scanner unit 22. The input/output control unit 32 inputs signals and instructions input via the network I/F 28 to the main control unit 30. The main control unit 30 also controls the input/output control unit 32 to access other devices via the network I/F 28.

The image processing unit 33 generates drawing information on the basis of print information contained in an input print job under the control of the main control unit 30. The drawing information is information for drawing an image to be formed in image forming operation by the print engine 26 that is an image forming unit. The print information contained in a print job is image information converted into a form that can be recognized by the image forming apparatus 1 by a printer driver installed in an information processing device such as a PC. The operation display control unit 34 displays information on the display panel 24, or informs the main control unit 30 of information input via the display panel 24.

When the image forming apparatus 1 operates as a printer, the input/output control unit 32 first receives a print job via the network I/F 28. The input/output control unit 32 transfers the received print job to the main control unit 30. Upon receiving the print job, the main control unit 30 controls the image processing unit 33 to generate drawing information on the basis of print information contained in the print job.

After the drawing information is generated by the image processing unit 33, the engine control unit 31 controls the print engine 26 on the basis of the generated drawing information to carry out image formation on a sheet conveyed from the paper feeding table 25. The print engine 26 thus functions as an image forming unit. A document on which image formation is carried out by the print engine 26 is ejected to the paper ejection tray 27.

When the image forming apparatus 1 operates as a scanner, the operation display control unit 34 or the input/output control unit 32 transfers a scan execution signal to the main control unit 30 in response to operation of the display panel 24 performed by the user or a scan execution instruction input from an external PC or the like via the network I/F 28. The main control unit 30 controls the engine control unit 31 on the basis of the received scan execution signal.

The engine control unit 31 drives the ADF 21 to convey an original to be imaged set on the ADF 21 to the scanner unit 22. The engine control unit 31 also drives the scanner unit 22 to image the original conveyed from the ADF 21. If no original is set on the ADF 21 and an original is directly set on the scanner unit 22, the scanner unit 22 images the set original under the control of the engine control unit 31. The scanner unit 22 thus operates as an imaging unit.

In imaging operation, an image sensor such as a CCD included in the scanner unit 22 optically scans the original, and imaging information generated on the basis of optical information is generated. The engine control unit 31 transfers the imaging information generated by the scanner unit 22 to the image processing unit 33. The image processing unit 33 generates image information on the basis of the imaging information received from the engine control unit 31 under the control of the main control unit 30. The image information generated by the image processing unit 33 is saved in a storage medium such as the HDD 14 mounted on the image forming apparatus 1. The scanner unit 22, the engine control unit 31, and the image processing unit 33 thus function as an original reading unit in cooperation.

The image information generated by the image processing unit 33 is stored without any change in the HDD 14 or the like or transmitted to an external device via the input/output control unit 32 and the network I/F 28 according to an instruction from the user. The ADF 21 and the engine control unit 31 thus function as an image input unit.

Furthermore, when the image forming apparatus 1 operates as a copier, the image processing unit 33 generates drawing information on the basis of the imaging information received by the engine control unit 31 from the scanner unit 22 or the image information generated by the image processing unit 33. The engine control unit 31 drives the print engine 26 on the basis of the drawing information similarly to the operation as a printer.

Figure 3:
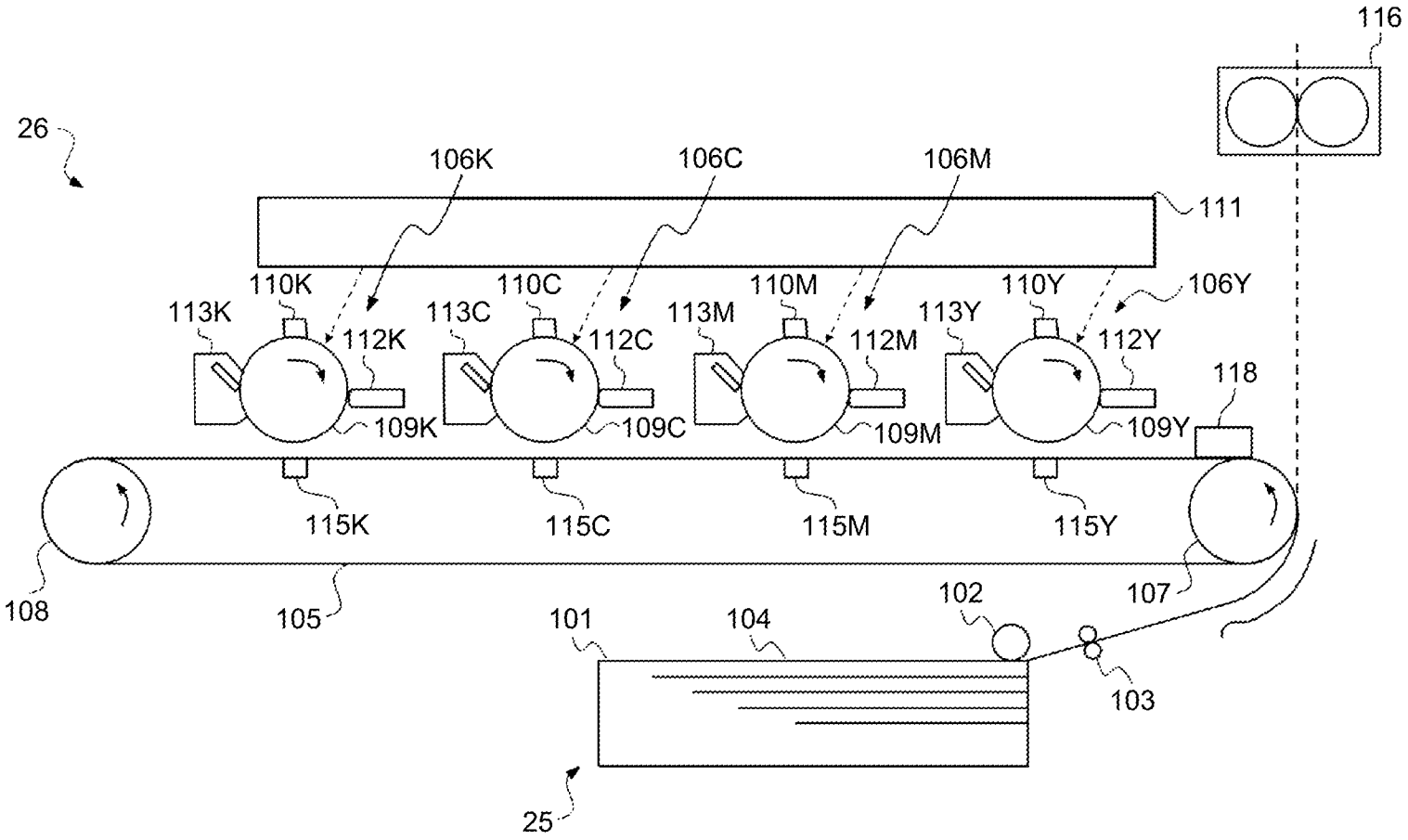
FIG. 3 is a diagram illustrating a configuration of a print engine according to the embodiment of the present invention.

Next, a configuration of the print engine 26 according to the present embodiment will be described with reference to FIG. 3. As illustrated in FIG. 3, the print engine 26 according to the present embodiment has a structure in which image forming units 106 of respective colors are arranged along a conveyance belt 105 that is endless moving means, which is of what is called a tandem type. Specifically, multiple image forming units (electrophotographic process units) 106Y, 106M, 106C, and 106K (hereinafter collectively referred to as image forming units 106) are arranged in this order from the upstream in the conveyance direction of the conveyance 105 along the conveyance belt 105 that is an intermediate transfer belt on which an intermediate transferred image to be transferred to a sheet (an example of a recording medium) 104 separately fed by a paper feeding roller 102 from a paper feeding tray 101 is formed.

Furthermore, the sheet 104 fed from the paper feeding tray 101 is once stopped by a registration roller 103 and fed to a position at which an image from the conveyance belt 105 is to be transferred at a timing of image formation at the image forming units 106.

The image forming units 106Y, 106M, 106C, and 106K are only different in the color of toner images to be formed and have the same internal configuration. The image forming unit 106K forms a black image, the image forming unit 106M forms a magenta image, the image forming unit 106C forms a cyan image, and the image forming unit 106Y forms a yellow image. The image forming unit 106Y will be concretely explained in the following description, and since the other image forming units 106M, 106C, and 106K are similar to the image forming unit 106Y, the components of the image forming units 106M, 106C, and 106K will only be illustrated with reference numerals distinguished by M, C and K instead of Y with which the components of the image forming unit 106Y are represented and the description thereof will not be repeated.

The conveyance belt 105 is an endless belt looped around a driving roller 107 that is driven to rotate and a driven roller 108. The driving roller 107 is driven to rotate by a drive motor, which is not illustrated, and the drive motor, the driving roller 107, and the driven roller 108 function as driving means that moves the conveyance belt 105 that is endless moving means.

In image formation, the first image forming unit 106Y transfers a yellow toner image onto the conveyance belt 105 that is driven to rotate. The image forming unit 106Y is constituted by a photoconductor drum 109Y that is a photoconductor, and a charging device 110Y, an optical writing device 111, a developing device 112Y, a photoconductor cleaner (not illustrated), a static eliminator 113Y, and the like arranged around the photoconductor drum 109Y. The optical writing device 111 is configured to emit light to the respective photoconductor drums 109Y, 109M, 109C, and 109K (hereinafter collectively referred to as "photoconductor drums 109").

In image formation, the outer circumferential surface of the photoconductor drum 109Y is uniformly charged by the charging device 110Y in the dark, and writing is then carried out on the outer circumferential surface using light from a light source corresponding to an yellow image from the optical writing device 111 to form an electrostatic latent image. The developing device 112Y converts the electrostatic latent image into a visible image using yellow toner, to thereby forma yellow toner image on the photoconductor drum 109Y.

The toner image is transferred onto the conveyance belt 105 by the operation of a transfer device 115Y at a position (transfer position) where the photoconductor drum 109Y and the conveyance belt 105 are in contact with or closest to each other. As a result of the transfer, a yellow toner image is formed on the conveyance belt 105. Unnecessary toner remaining on the outer circumferential surface of the photoconductor drum 109Y after transfer of the toner image is completed is swept up by the photoconductor cleaner, and the photoconductor drum 109Y is then neutralized by the static eliminator 113Y and waits for the next image formation.

The yellow toner image transferred onto the conveyance belt 105 by the image forming unit 106Y as described above is conveyed to the next image forming unit 106M by the conveyance belt 105 driven by the roller. At the image forming unit 106M, a magenta toner image is formed on the photoconductor drum. 109M through the same process as the image forming process at the image forming unit 106Y, and the toner image is transferred to be superimposed onto the yellow image formed previously.

The yellow and magenta toner image transferred on the conveyance belt 105 is further convey to the next image forming units 106C and 106K at which a cyan toner image formed on the photoconductor drum 109C and a black toner image formed on the photoconductor drum 109K are transferred to be superimposed onto the image transferred previously through the same operation. In this manner, a full-color intermediate transferred image is formed on the conveyance belt 105.

Sheets 104 accommodated on the paper feeding tray 101 are sequentially fed from the top, and the intermediate transferred image formed on the conveyance belt 105 is transferred onto the sheet at the position where the conveyance path of the sheet is in contact with or closest to the conveyance belt 105. As a result, an image is formed on a surface of the sheet 104. The sheet 104 on the surface of which the image is formed is further conveyed, the image fixed at a fixing device 116, and the sheet 104 is then ejected outside the image forming apparatus.

In addition, a belt cleaner 118 is provided to remove toner remaining on the conveyance belt 105 without being transferred onto the sheet. As illustrated in FIG. 3, the belt cleaner 118 is a cleaning blade pressed against the conveyance belt 105 downstream of the driving roller 107 and upstream of the photoconductor drum 109, which is a developer removing unit to scrape out toner adhered to the surface of the conveyance belt 105.

Figure 4:
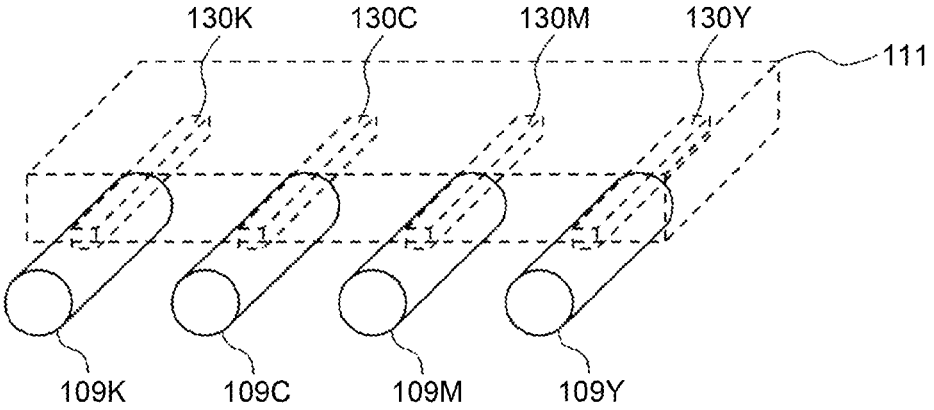
FIG. 4 is a diagram illustrating a configuration of an optical writing device according to the embodiment of the present invention.

Next, the optical writing device 111 according to the present embodiment will be described. FIG. 4 is a diagram illustrating relative positions of the optical writing device 111 and the photoconductor drums 109. As illustrated in FIG. 4, irradiation light rays emitted to the photoconductor drums 109Y, 109M, 109C, and 109K of the respective colors are emitted from light-emitting diode array (LEDA) print heads 130Y, 130M, 130C, and 130K (hereinafter collectively referred to as LEDA print heads 130), respectively, that are light source devices.

Figure 5:
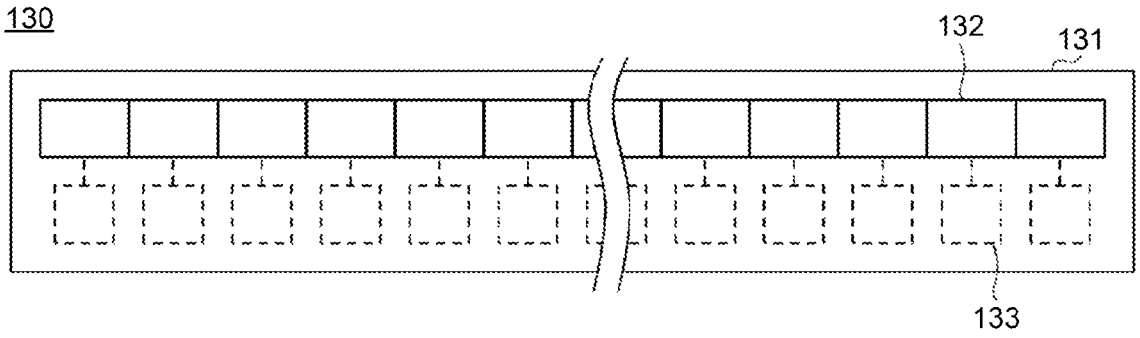
FIG. 5 is a diagram illustrating a configuration of a LEDA print head according to the embodiment of the present invention.

FIG. 5 is a diagram illustrating a configuration of a LEDA print head 130. FIG. 5 illustrates an irradiation surface of a LEDA that is a light source included in the LEDA print head 130 in front view. As illustrated in FIG. 5, the LEDA print head 130 includes multiple LEDAs 132 on a substrate 131. The direction in which the LEDAs 132 are arranged corresponds to the main-scanning direction of the photoconductor drums 109.

Each of the LEDAs 132 is a light emitting element array including multiple LED elements that are light emitting elements arranged in the same direction as the direction in which the LEDAs 132 are arranged. Each of the LED elements included in each of the LEDAs 132 emits light for one pixel.

Furthermore, multiple drive circuits 133 to drive the respective LEDAs 132 for irradiation are provided in the substrate 131. The respective drive circuits 133 correspond one-to-one to the respective LEDAs 132.

A control unit included in the optical writing device 111 controls the on/off states of each of the LEDs arranged in the main-scanning direction in the LEDA print head 130 for each main scanning line on the basis of drawing information input from the controller 20, selectively exposes the surfaces of the photoconductor drums 109 to form an electrostatic latent image.

As illustrated in FIG. 5, one LEDA print head 130 includes multiple LEDAs 132. If the light emitting characteristics of the respective LEDAs 132 are different, the irradiation light quantities of the LEDAs 132 may vary even when the LEDAs 132 are driven under the same condition via the respective drive circuits 133.

Furthermore, as illustrated in FIG. 4, the optical writing device 111 includes multiple LEDA print heads 130 for the respective colors of CMYK. Similarly, the irradiation light quantities may vary among the respective LEDA print heads 130 owing to the difference in the light emitting characteristics of the LEDAs 132 mentioned above.

The irradiation light quantities of the LEDA print heads 130 affect the densities of toner images developed on the photoconductor drums 109. Thus, the aforementioned variation in the irradiation light quantities appears as variation in the densities of a finally formed image, and an intended image will not be formed. Such variation in the irradiation light quantities is adjusted by control of the control unit included in the optical writing device 111.

Figure 6:
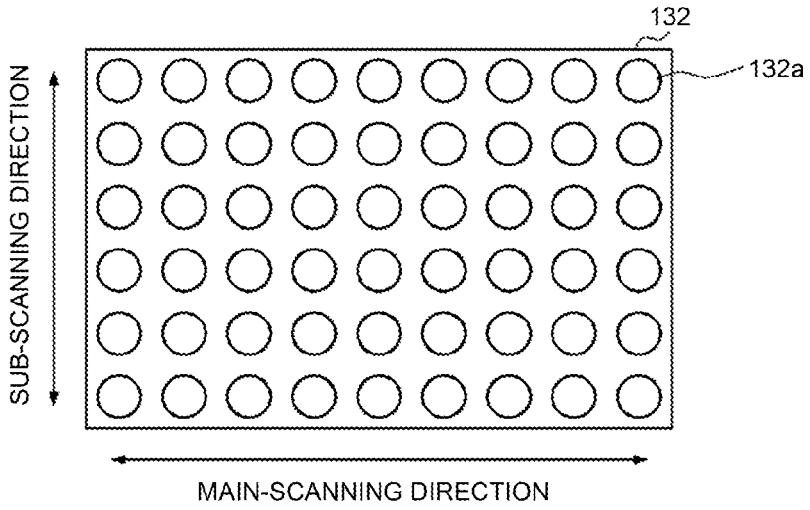
FIG. 6 is a diagram illustrating a configuration of LED elements in a LEDA according to the embodiment of the present invention.

Next, a configuration of each LEDA 132 according to the present embodiment will be described with reference to FIG. 6. FIG. 6 is a diagram of the irradiation surface from which a LEDA 132 according to the present embodiment emits light in front view, in which the vertical direction corresponds to the sub-scanning direction and the horizontal direction corresponds to the main-scanning direction. As illustrated in FIG. 6, in a LEDA 132 according to the present embodiment, multiple LED elements 132*a* that are light emitting elements are arranged in the main-scanning direction and the sub-scanning direction.

Although an example in which six LED elements 132*a* are arranged in the sub-scanning direction is presented in the present embodiment, five or less or seven or more LED elements 132*a* may be arranged. The six LED elements arranged in the sub-scanning direction are used as a light emitting element line to carry out exposure for one pixel in the main-scanning direction.

FIG. 6 illustrates a state in which the LED elements 132*a* are regularly arranged in the main-scanning direction and in the sub-scanning direction. There may be, however, cases where the attachment positions of the LED elements 132*a* are individually misaligned, where the LEDAs 132 are mounted on the substrate 131 in a state in which the LEDAs 132 are misaligned or tilted, or where the LEDA print heads 130 themselves are mounted in an tilted state on the optical writing device 111. An aspect of the present embodiment is to overcome an adverse effect of such attachment error by adjusting the light quantities of the respective LED elements 132*a*.

Figure 7:
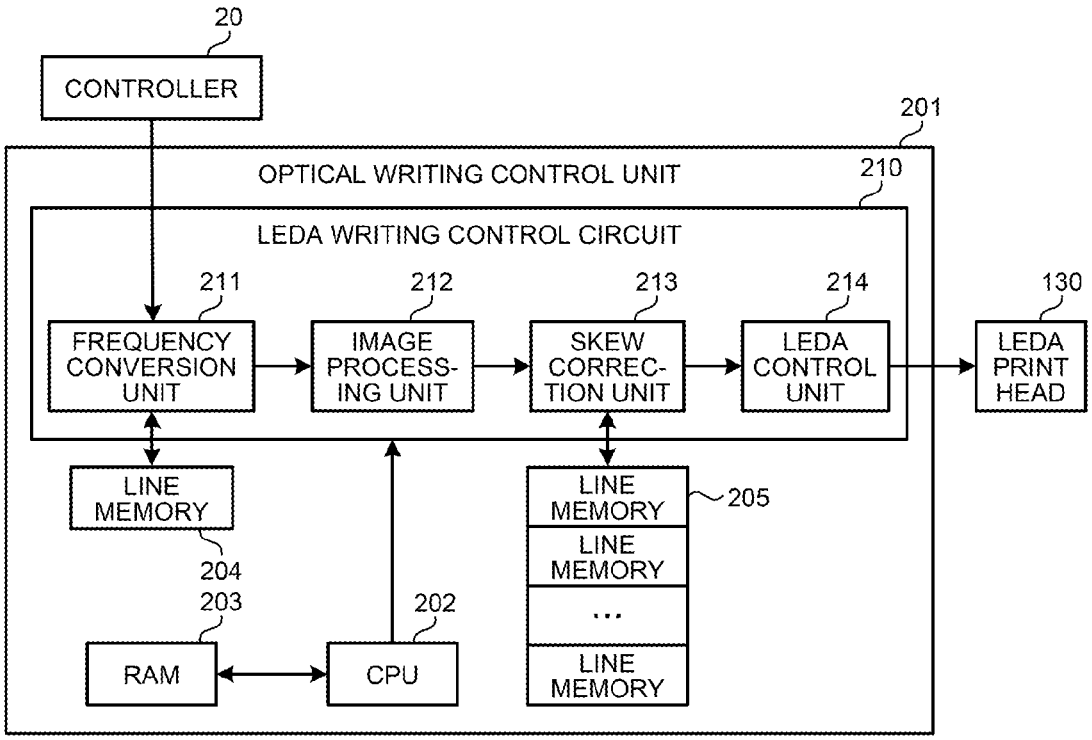
FIG. 7 is a diagram illustrating a functional configuration of an optical writing control unit according to the embodiment of the present invention.

Next, a control block of the optical writing device 111 according to the present embodiment will be described with reference to FIG. 7. FIG. 7 is a diagram illustrating a functional configuration of an optical writing control unit 201 that controls the LEDA print heads 130 in the optical writing device 111 according to the present embodiment and the relation of connections between the LEDA print heads 130 and the controller 20.

As illustrated in FIG. 7, the optical writing control unit 201 according to the present embodiment includes a CPU 202 that controls operation of the entire optical writing device 111, a RAM 203 that is a main storage device, line memories 204 and 205, and the LEDA writing control circuit 210. The LEDA writing control circuit 210 includes a frequency conversion unit 211, an image processing unit 212, a skew correction unit 213, and a LEDA control unit 214.

Thus, the optical writing control unit 201 according to the present embodiment is implemented by combination of a software control unit formed by computation of the CPU 202 according to control programs stored in a storage medium and loaded onto the RAM 203 and hardware, similarly to the hardware configuration described with reference to FIG. 1.

Although the configuration and functions of the optical writing control unit 201 with respect to a LEDA print head 130 will be explained in the following description, the LEDA print heads 130 are provided in association with the respective photoconductor drums 109K, 109M, 109C, and 109Y as described with reference to FIGS. 3 and 4. The optical writing control unit 201 thus has functions of controlling each of the LEDA print heads 130 and each of the photoconductor drums 109 of the respective colors.

The LEDA writing control circuit 210 is a control circuit that controls emission of the LEDA print head 130 on the basis of drawing information input from the controller 20, is implemented by hardware such as integrated circuits, and operates under the control of the CPU 202. The frequency conversion unit 211 converts the operating frequency of drawing information input from the controller 20 to that of the LEDA writing control circuit 210 and outputs the resulting drawing information.

The frequency conversion unit 211 thus temporarily stores the drawing information input from the controller 20 in a line memory 204 provided for frequency conversion, and outputs the drawing information according to the operating frequency of the LEDA writing control circuit 210. The frequency conversion unit 211 also functions as an image information acquisition unit that acquires image information input from the controller 20.

The image processing unit 212 carries out various image processing on image data subjected to frequency conversion and output. Examples of image processing carried out by the image processing unit 212 include changing the image size, trimming, and adding an internal pattern. The image processing unit 212 also controls the timing at which the image data are output to the skew correction unit 213 that is a subsequent processing module to carry out correction of misregistration in the main-scanning direction in units of resolution input from the controller 20. The correction of misregistration in the main-scanning direction is carried out according to register settings made by the CPU 202 on the LEDA writing control circuit 210.

Furthermore, the image processing unit 212 carries out a binarization process of converting drawing information input as multiple tone image information from the frequency conversion unit 211 into two tones of colored/colorless to finally generate pixel information for controlling irradiation of the LEDA print head 130. In the binarization process according to the present embodiment, the image processing unit 212 refers to a tone conversion table generated beforehand and stored in a storage medium in the optical writing control unit 201 on the basis of 4-bit pixel data input from the frequency conversion unit 211 to final generate pixel information for controlling irradiation of the LEDA print head 130.

Although an example in which 4-bit pixel data are input from the controller 20 is described in the present embodiment, this is only an example and data of more tones such as 8 bits or data of less tones such as 2 bits may be used.

The skew correction unit 213 corrects skewing of images resulting from various causes such as an error due to arrangement of the LEDA print heads 130 and the photoconductor drums 109. Parameter values relating to skew correction may be generated on the basis of a result of reading a pattern for misregistration correction formed on the conveyance belt 105 or acquired on the basis of information stored in a storage medium provided in the LEDA print head 130, and are set in the skew correction unit 213 under the control of the CPU 202.

The skew correction unit 213 carries out skew correction by storing image data input from the image processing unit 212 in each main scanning line of the line memory 205 and reading the image data from the line memory 205 according to the set parameter values.

The skew correction unit 213 shifts the line from which pixel data are to be read out at a predetermined position on the main scanning line according to the tilt of an image to be corrected in a state in which pixel data of multiple main-scanning lines are stored in the line memory 205. For example, when pixel data are read out from the first line, the skew correction unit 213 switches the main scanning line from which pixel data are to be read to the second line at the predetermined position (hereinafter referred to as a "shift position") on the main-scanning line. As a result of such processing the tilt of an image can be corrected.

The LEDA control unit 214 controls emission of the LEDA print head 130 according to the operating frequency on the basis of pixel information output from the skew correction unit 213. The LEDA control unit 214 controls the light quantities of the LED elements that are light emitting elements constituting the LEDA print head 130 on the basis of correction data stored in storage medium included in the LEDA print head 130. The control of the light quantity of the LEDA print head 130 is one aspect according to the present embodiment.

Figure 8:
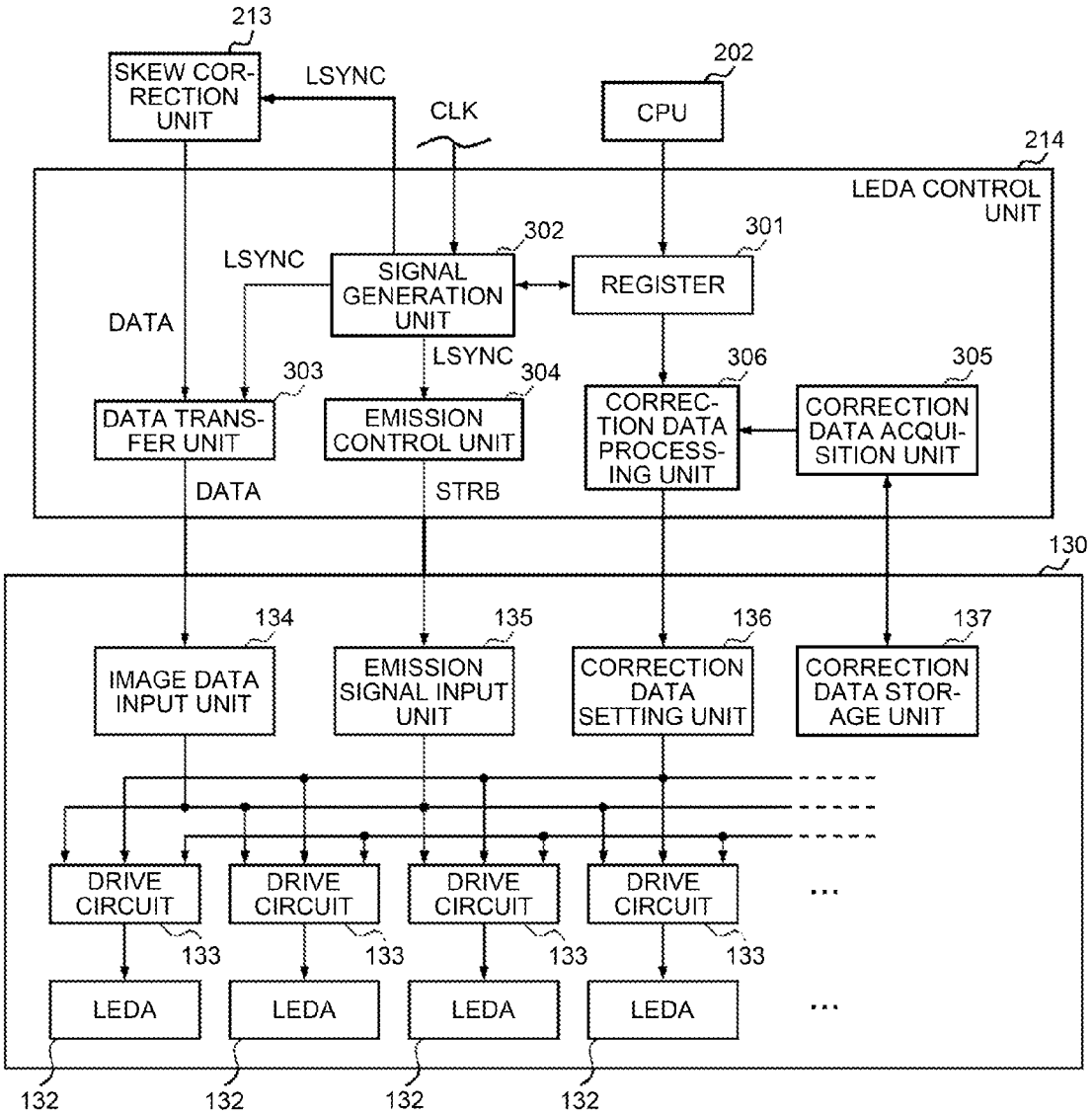
FIG. 8 is a diagram illustrating a functional configuration of a LEDA control unit according to the embodiment of the present invention.

Next, specific configurations of the LEDA control unit 214 and the LEDA print head 130 according to the present embodiment will be described with reference to FIG. 8. FIG. 8 is a diagram illustrating functional configurations of and the relation of corrections between the LEDA control unit 214 and the LEDA print head 130 according to the present embodiment. As illustrated in FIG. 8, the LEDA control unit 214 according to the present embodiment includes a register 301, a signal generation unit 302, a data transfer unit 303, an emission control unit 304, a correction data acquisition unit 305, and a correction data processing unit 306.

The register 301 is a storage unit that stores parameter values set by the CPU 202. The signal generation unit 302 generates and outputs a line periodic signal LSYNC representing an emission period of the LEDA print head 130 of each main scanning line on the basis of a reference clock CLK input from outside of the LEDA control unit 214.

The signal generation unit 302 generates and outputs a LSYNC for each of the colors CMYK. In this process, the signal generation unit 302 adjusts the timings of the LSYNCs of the respective colors on the basis of correction values set in the register 301. Note that the LSYNCs are also input to the skew correction unit 213 for switching of image data on each line.

The data transfer unit 303 transfers image data DATA input from the skew correction unit 213 to the LEDA print head 130 according to the timings of the LSYNCs input from the signal generation unit 302. The emission control unit 304 outputs a strobe signal STRB for controlling emission of the LEDA print head 130 according to the timings of the LSYNCs input from the signal generation unit 302.

The correction data acquisition unit 305 acquires correction data for each LEDA print head 130 from a correction data storage unit 137 provided in the LEDA print head 130. The correction data storage unit 137 stores information such as the amounts of misalignment and variation in the light quantities of the respective LED elements 132*a* included in a LEDA 132. Details will be described later.

The correction data acquisition unit 305 acquires such correction data from the correction data storage unit 137 and inputs the acquired correction data to the correction data processing unit 306. The correction data processing unit 306 carries out necessary processing on the correction data input from the correction data acquisition unit 305, generates correction values of emission time and drive current, and inputs the correction values to the LEDA print head 130 for setting correction data.

At the LEDA print head 130, the emission signal input unit 135 acquires the STRB input from the emission control unit 304 and inputs the STRB to the drive circuit 133 associated with each LEDA 132.

The data signal DATA input from the data transfer unit 303 is acquired by the image data input unit 134 at the LEDA print head 130 and input to the drive circuit 133 associated each LEDA 132. The image data input unit 134 expands the data signal DATA input as serial data to parallel data, and is thus a shift register, for example.

The correction data input from the correction data processing unit 306 are acquired by a correction data setting unit 136 at the LEDA print head 130. The correction data setting unit 136 sets emission time and drive current for the drive circuit 133 associated with each LEDA 132 on the basis of the acquired correction data.

The drive circuit 133 switches on/off of multiple LED elements included in each LEDA 132 on the basis of the DATA input from the image data input unit 134, and drives the LEDA 132 to emit light according to the strobe signal STRB input from the emission signal input unit 135. In this process, the drive circuit 133 drives the LEDA 132 to emit light with the emission time and the drive current set by the correction data setting unit 136.

Specifically, the drive circuit 133 drives the LEDA 132 to emit light according to the strobe signal STRB input from the emission signal input unit 135 but corrects the emission time on the basis of the set correction value of the emission time. In driving the LEDA 132 to emit light according to the strobe signal STRB input from the emission signal input unit 135, the drive circuit 133 also corrects the drive current for driving the LEDA 132 to emit light on the basis of the set correction value of the drive current.

With such a configuration, at the LEDA print head 130, the respective LED elements 132*a* included in each LEDA 132 selectively emit light according to the DATA input from the data transfer unit 303. As a result, the surface of the photoconductor drum 109 is selectively exposed and an electrostatic latent image corresponding to the image data is formed. Thus, at the LEDA control unit 214, the data transfer unit 303 and the emission control unit 304 function as a light source control unit in cooperation.

Furthermore, since the drive circuit 133 corrects the drive time for driving the respective LED elements 132*a* included in the LEDA 132 to emit light according to the set correction values, the emission time of the LED elements included in each LEDA 132 is time based on data saved in the correction data storage unit 137. Similarly, since the drive circuit 133 corrects the drive time for driving the respective LED elements 132*a* included in the LEDA 132 to emit light according to the set correction values, the drive current of the LED elements included in each LEDA 132 is a value based on data saved in the correction data storage unit 137.

Figure 9A:
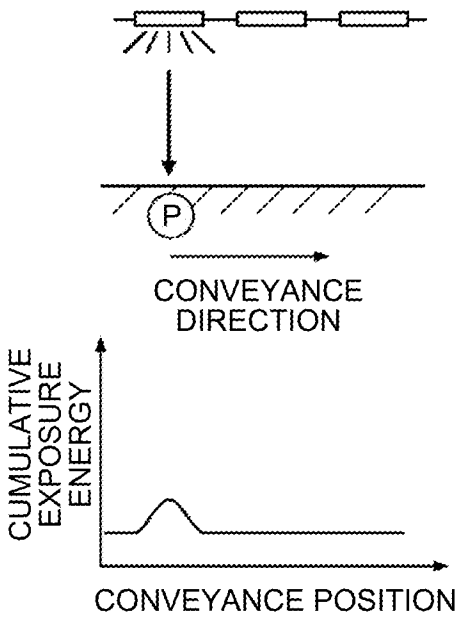
FIGS. 9A to 9C are graphs illustrating changes in cumulative exposure energy with multiple times of exposure according to the embodiment of the present invention.
Figure 9B:
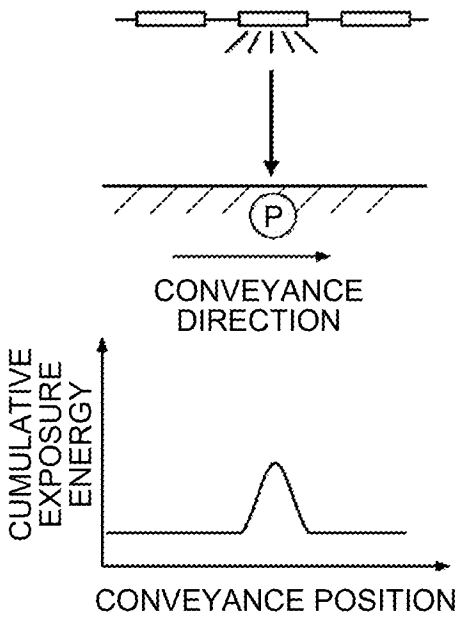
Figure 9C:
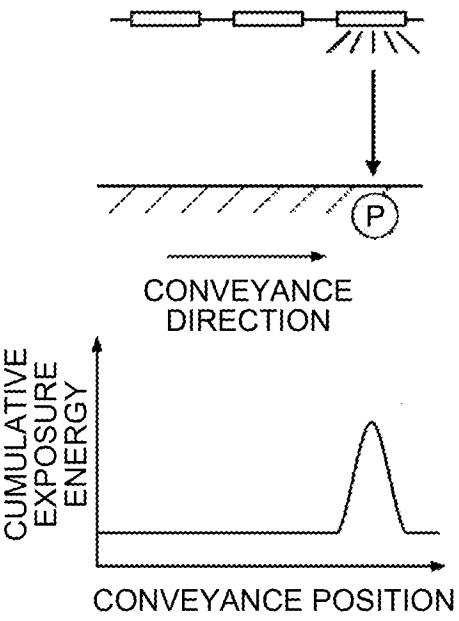

Here, a mode of increasing the exposure amount at the same position on the surface of the photoconductor drum 109 by sequentially lighting the multiple LED elements 132*a* arranged in the sub-scanning direction, that is, in the conveyance direction of the photoconductor drum 109 as described with reference to FIG. 6 will be described. FIGS. 9A to 9C are diagrams illustrating changes in cumulative exposure energy when the multiple LED elements 132*a* arranged in the conveyance direction are sequentially lit, in which the upper part illustrates the relative positions of the LED elements 132*a* and the surface of the photoconductor drum 109 and the lower part illustrates graphs of the cumulative exposure energy depending on the conveyance position.

FIGS. 9A to 9C illustrate a mode of increasing the cumulative exposure energy at the same position by sequentially lighting three LED elements 132*a* arranged in the conveyance direction with the conveyance of the surface of the photoconductor drum 109. As illustrated in FIG. 9A, as a result of lighting a LED element 132*a* arranged upstream in the conveyance direction on the left in the drawing at a certain timing, a position P opposed to the left LED element 132*a* is exposed. As a result, the cumulative exposure energy at the conveyance position P is increased as illustrated in the graph of the lower part.

After the photoconductor drum 109 is further conveyed from the timing illustrated in FIG. 9A, the position P on the surface of the photoconductor drum 109 reaches a position opposed to the central LED element 132*a* as illustrated in FIG. 9B. As a result of lighting the central LED element 132*a* at this timing, the cumulative exposure energy at the conveyance position P is accumulated and increased as illustrated in the graph of the lower part.

After the photoconductor drum 109 is further conveyed from the timing illustrated in FIG. 9B, the position P on the surface of the photoconductor drum 109 reaches a position opposed to the left LED element 132*a* as illustrated in FIG. 9C. As a result of lighting the left LED element 132*a* at this timing, the cumulative exposure energy at the conveyance position P is accumulated and further increased as illustrated in the graph of the lower part.

The exposure amount at the same position on the surface of the photoconductor drum 109 can be increased by sequentially lighting the multiple LED elements 132*a* arranged in the conveyance direction under the lighting control in this manner. As a result, even when the light quantity of each of the LED elements 132*a* is low, the exposure amount on the surface of the photoconductor drum 109 can be sufficiently ensured.

Figure 10A:
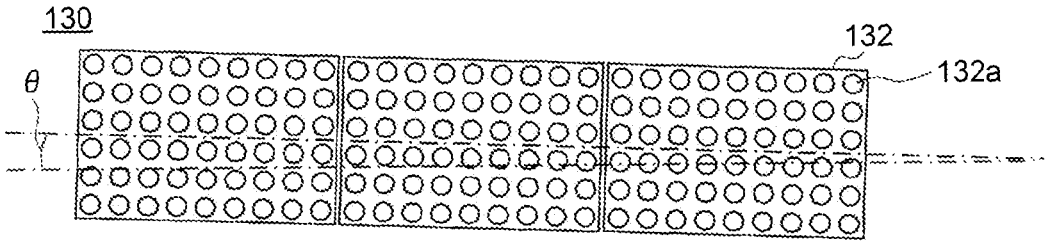
FIGS. 10A and 10B are diagrams illustrating examples of attachment error of the LEDA print head according to the embodiment of the present invention.

Next, attachment error of the LEDA print heads 130 and attachment error of the LEDAs 132 will be described. FIG. 10A is a diagram illustrating attachment error of a LEDA print head 130. As described with reference to FIG. 5, the LEDA print head 130 according to the present embodiment includes multiple LEDAs 132 arranged in the main-scanning direction. It is assumed that the direction in which the LEDAs 132 are arranged is parallel to the main-scanning direction on the surface of the photoconductor drum 109, but it is difficult to ensure a completely parallel state in view of manufacturing tolerances.

In the case of FIG. 10A, the direction in which the LEDAs 132 are arranged is tilted at an angle θ with respect to the main-scanning direction. If an electrostatic latent image is formed in a state in which such a tilt is caused, an electrostatic latent image tilted at the angle θ is formed on the surface of the photoconductor drum 109. Furthermore, the tilt at the angle θ causes an adverse effect on multiple times of exposure in the sub-scanning direction as described with reference to FIG. 9.

Figure 10B:
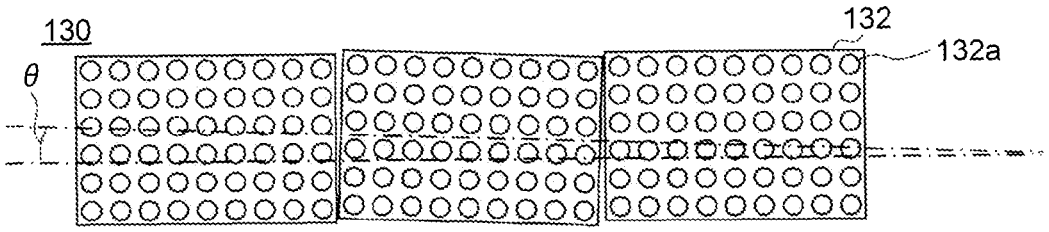

In the case of FIG. 10B, a LEDA 132 positioned at the center in the drawing among the multiple LEDAs 132 is tilted at the angle θ with respect to the other LEDAs 132. If an electrostatic latent image is formed in a state in which such a tilt is caused, there will be a problem that part of the image formed by exposure by the tilted LEDA 132 is tilted and distorted and an adverse effect on multiple times of exposure in the sub-scanning direction as described with reference to FIG. 9 will be produced.

Figure 11A:
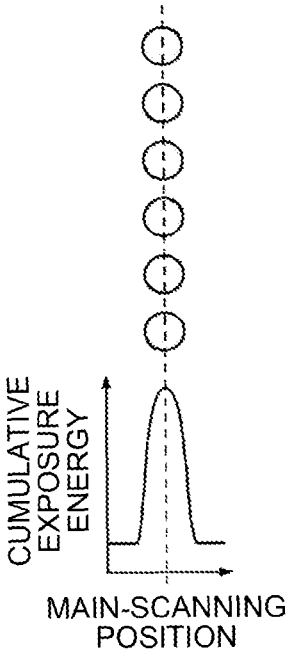
FIGS. 11A and 11B are graphs illustrating adverse effects caused by the attachment error according to the embodiment of the present invention.
Figure 11B:
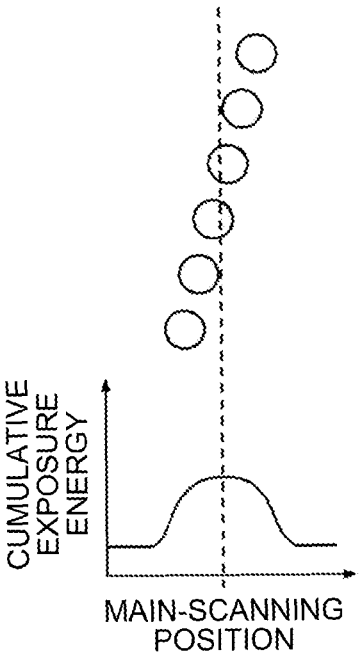

FIGS. 11A and 11B are graphs illustrating adverse effects caused in multiple times of exposure in the sub-scanning direction as described with reference to FIG. 9 in the cases where the tilts as described with reference to FIGS. 10A and 10B are caused. The upper parts of the drawings illustrate the tilt state in the arrangement direction of a row of the LED elements 132*a* (hereinafter referred to as a "LED element row") arranged in the sub-scanning direction, and the lower parts of the drawings are graphs illustrating the spread of exposure energy in the main-scanning direction at a position in the sub-scanning direction on the surface of the photoconductor drum 109.

FIG. 11A is a diagram illustrating exposure energy obtained as a result of exposure of one row in a normal state in which no tilt is caused. As illustrated in FIG. 11A, when the arrangement direction of the LED elements 132*a* is not tilted with respect to the conveyance direction of the surface of the photoconductor drum 109, the exposure energies of the respective LED elements 132*a* are added to the same position in the main-scanning direction on the surface of the photoconductor drum 109. As a result, the cumulative exposure energy is distributed with a peak at the position where the LED elements 132*a* are arranged and with a spread corresponding to an exposure range of one LED element 132*a*.

In contrast, FIG. 11B is a diagram illustrating exposure energy obtained as a result of exposure of one row in a tilted state. As illustrated in FIG. 11B, when the arrangement direction of the LED elements 132*a* is tilted with respect to the conveyance direction of the surface of the photoconductor drum 109, the exposure energies of the respective LED elements 132*a* are added to positions slightly shifted from one another in the main-scanning direction on the surface of the photoconductor drum 109.

As a result, the cumulative exposure energy is distributed with a peak at the center of a range in the main-scanning direction in which the LED elements 132*a* are arranged and with a spread corresponding to an arrangement range of one LED element 132*a*. Thus, the distribution has a lower peak and a wider region to which exposure energies are added in the main-scanning direction than that in the normal state illustrated in FIG. 11A. When the exposure energy corresponding to one pixel changes in this manner, the image will be faintly blurred and the quality of a finally formed image will be deteriorated. On aspect of the present embodiment is to overcome such an adverse effect.

Figure 12:
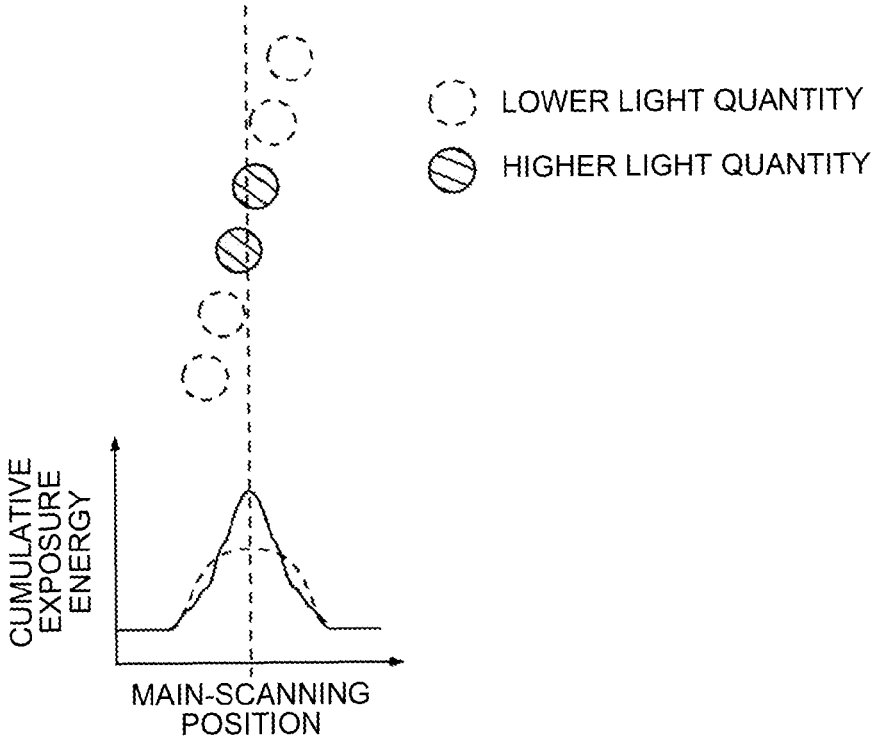
FIG. 12 is a graph illustrating a mode of light quantity control for removing the attachment error of the LEDA according to the embodiment of the present invention.

FIG. 12 is a diagram illustrating a mode of solving the problem as illustrated in FIG. 11B by adjusting the light quantities of the LED elements 132*a* according to the present embodiment. FIG. 12 illustrates a mode of adjusting the peak value and the spread of the cumulative exposure energy by adjusting the light quantities of the respective LED elements 132*a* on the assumption of the state illustrated in FIG. 11B. In FIG. 12, LED elements 132*a* presented in broken lines represent LED elements 132*a* that emit light at a lower light quantity, and LED elements 132*a* presented with hatching represent LED elements 132*a* that emit light at a higher light quantity.

In the adjustment mode illustrated in FIG. 12, adjustment is carried out so that the light quantities of two of six LED elements 132*a* at the center are increased and that the light quantities of the other LED elements 132*a* are decreased. As a result, the peak is higher and the light quantity is more centrally distributed than those in the distribution in the main-scanning direction of the exposure energy before the adjustment illustrated in a broken line in the graph, which is closer to the state in FIG. 11A.

In other words, in adjustment of the light quantities of the LED elements 132*a* according to the present embodiment, the spread in the main-scanning direction of the arrangement positions of the LED elements constituting a LED element row is acquired on the basis of the tilt of the LED element row with respect to the sub-scanning direction, and the light quantities of the respective LED elements 132*a* are adjusted on the basis of the acquisition result.

In the adjustment of the light quantities of the respective LED elements 132*a*, the light quantities of the LED elements 132*a* are adjusted so that the spread of the distribution in the main-scanning direction of the exposure amount accumulated on the photoconductor by sequentially lighting the LED elements 132*a* constituting the LED element row is adjusted.

Although an example in which the light quantities of the LED elements 132*a* other than the two central LED elements 132*a* are lowered is presented in the mode of FIG. 12, the LED elements 132*a* at both ends may alternatively be turned off, for example. As a result, the distribution in the main-scanning direction of the cumulative exposure energy can be made more centrally concentrated.

Figure 13:
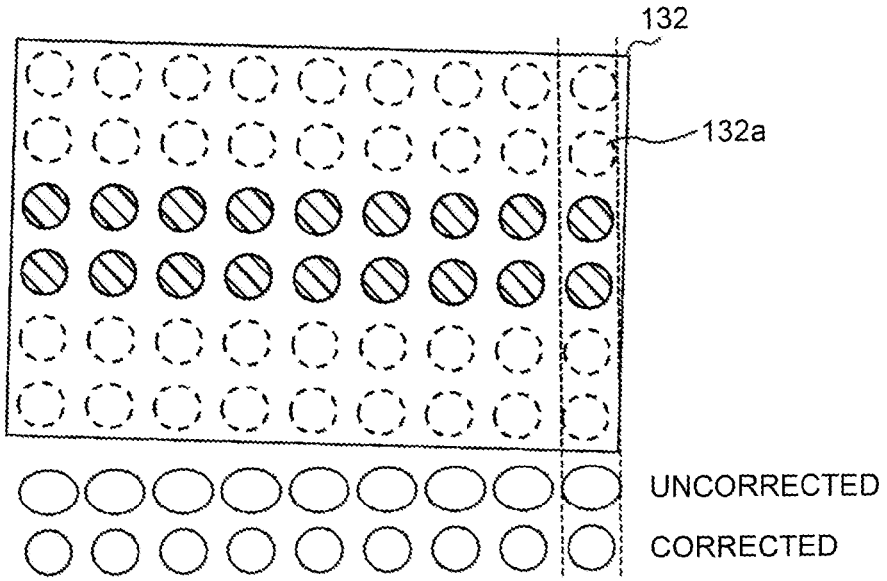
FIG. 13 is a diagram illustrating a mode of light quantity control for removing the attachment error of the LEDA print head and the LEDA according to the embodiment of the present invention.

FIG. 13 is a diagram illustrating uncorrected and corrected states when light quantity adjustment as described in FIG. 12 is carried out on the spread in the main-scanning direction of spots exposed by the LED element row arranged in the sub-scanning direction.

As illustrated in FIG. 13, in the uncorrected state, the arrangement direction of one LED element row is tilted with respect to the sub-scanning direction, and thus spots to be exposed are wider in the main-scanning direction as the range of the arrangement of the LED elements 132*a* are wider in the main-scanning direction. In contrast, as a result of carrying out the correction illustrated in FIG. 12, the spread in the main-scanning direction of the cumulative exposure energy applied by one LED element row can be made more concentrated to the center of the arrangement range in the main-scanning direction of the respective LED element rows.

Figure 14:
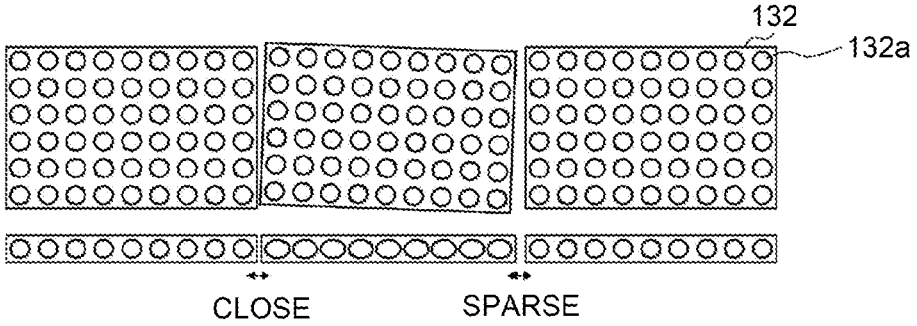
FIG. 14 is a diagram illustrating an error of intervals between LEDAs due to the LEDA attachment error according to the embodiment of the present invention.

Next, correction of sparseness and closeness of adjacent LEDAs 132 caused by arrangement error of the LEDAs 132 in a LEDA print head 130 will be described. FIG. 14 is a diagram illustrating sparseness and closeness of adjacent LEDAs 132 caused by arrangement error of the LEDAs 132.

In the example of FIG. 14, an error in the arrangement of a LEDA 132 at the center of the drawing is caused, and the central LEDA 132 is tilted and shifted to the left. Thus, the space between the left LEDA 132 and the central LEDA 132 in FIG. 12 is narrow and close while the space between the right LEDA 132 and the central LEDA 132 in FIG. 12 is wide and sparse. When there are such sparseness and closeness between the LEDAs 132, the density of an image changes at joints of the LEDAs, which leads to deterioration in the image quality such as a line appearing in the sub-scanning direction.

Figure 15A:
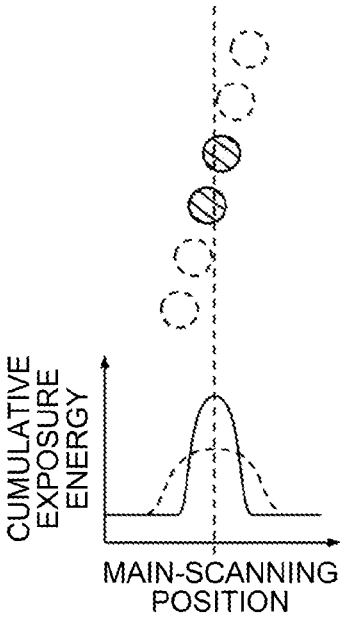
FIGS. 15A and 15B are graphs illustrating a mode of adjustment of the intervals between LEDAs due to the LEDA attachment error according to the embodiment of the present invention.
Figure 15B:
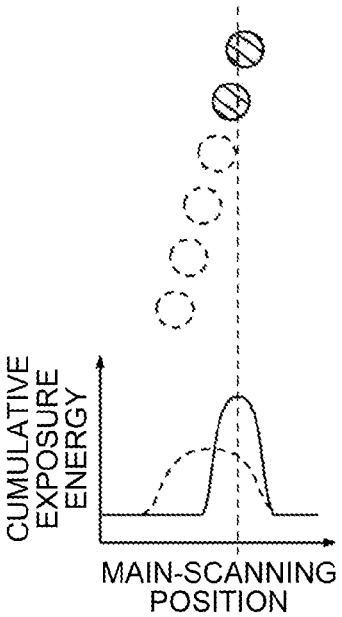

FIGS. 15A and 15B are diagrams illustrating a mode of solving the problem as illustrated in FIG. 14 by adjusting the light quantities of the LED elements 132*a* according to the present embodiment. FIGS. 15A and 15B illustrate a mode of adjusting the position of the peak in the main-scanning direction in adjusting the peak value and the spread of the cumulative exposure energy by adjusting the light quantities of the respective LED elements 132*a*. In FIGS. 15A and 15B, LED elements 132*a* presented in broken lines represent LED elements 132*a* that emit light at a lower light quantity, and LED elements 132*a* presented with hatching represent LED elements 132*a* that emit light at a higher light quantity.

FIG. 15A is a diagram illustrating a mode of adjustment corresponding to FIG. 12. In the case of FIG. 15A, since adjustment is carried out so that the light quantities of two of six LED elements 132*a* at the center are increased and that the light quantities of the other LED elements 132*a* are decreased, the peak of the cumulative exposure energy is located at the center of the range in the main-scanning direction in which six LED elements 132*a* are arranged.

In contrast, in the case of FIG. 15B, adjustment is carried out so that the light quantities of the upper two of six LED elements 132*a* in FIG. 15B are increased and that the light quantities of the other LED elements 132*a* are decreased. The upper two LED elements 132*a* in FIG. 15B are two LED elements 132*a* on the right in the main-scanning direction in the range in the main-scanning direction in which the six LED elements 132*a* are arranged. Thus, the peak of the cumulative exposure energy is located on the right of the range in the main-scanning direction in which the six LED elements 132*a* are arranged. As a result, the positions of the exposure spots of the respective LED element rows included in the LEDA 132 can be gradually shifted to the right.

Figure 16:
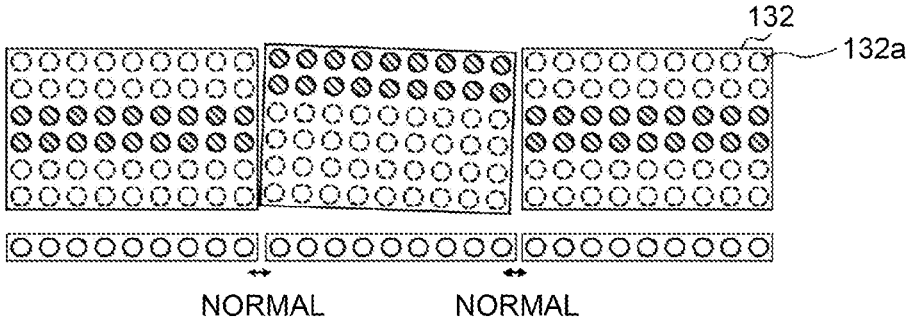
FIG. 16 is a diagram illustrating a mode of adjustment of the intervals between LEDAs due to the LEDA attachment error according to the embodiment of the present invention.

FIG. 16 is a diagram illustrating a mode of adjusting sparseness and closeness of the LEDAs 132 according to the mode of adjustment as illustrated in FIGS. 15A and 15B when misalignment as illustrated in FIG. 14 is caused. As illustrated in FIG. 16, the light quantities of the respective LED elements 132*a* in the respective LED element rows included in the LEDA 132 presented at the center in FIG. 16 are adjusted so that the peak of the cumulative exposure energy will be shifted to the right as described with reference to FIGS. 15A and 15B.

In contrast, adjustment of the respective LED element rows included in the left and right LEDAs 132 is carried out so that the light quantities of the central two LED elements 132*a* included in each LED element row are increased and that the light quantities of the other LED elements 132*a* are decreased to adjust the exposure amount to that of the central LEDA 132 in the example of FIG. 16, while the peak position of the cumulative exposure energy is not particularly adjusted.

In the mode illustrated in FIG. 16, the positions in the main-scanning direction of spots exposed by the respective LED element rows included in the central LEDA 132 are shifted to the right as compared to those in the normal state. As a result, the space between the central LEDA 132 and the left LEDA 132 becomes wider, and the space between the central LEDA 132 and the left LEDA 132 that was narrow as described with reference to FIG. 14 thus becomes a normal space.

In addition, the space between the central LEDA 132 and the right LEDA 132 becomes narrower, and the space between the central LEDA 132 and the right LEDA 132 that was wide as described with reference to FIG. 14 thus becomes a normal space. According to such a mode, the adverse effect of sparseness and closeness between LEDAs 132 caused by arrangement error of the LEDAs 132 can be overcome.

In other words, in adjustment of the light quantities of the LED elements 132*a* according to the present embodiment, the intervals of the LED element rows included in adjacent LEDAs 132 among the LEDAs 132 constituting a LEDA print head 130 are acquired, and the light quantities of the respective LED elements 132*a* are adjusted on the basis of the acquisition result. In the adjustment of the light quantities of the respective LED elements 132*a*, the light quantities of the LED elements 132*a* are adjusted so that the position of the distribution in the main-scanning direction of the exposure amount accumulated on the photoconductor by sequentially lighting the LED elements 132*a* constituting the LED element row is adjusted.

Next, the relation between the adjustment of the range in the main-scanning direction of the exposure spots of the respective LED element rows described with reference to FIGS. 12 and 13 and the adjustment of sparseness and closeness between adjacent LEDAs 132 described with reference to FIGS. 15A, 15B, and 16 will be described. Each of multiple LEDAs 132 that are arranged needs to be adjusted as described with reference to FIG. 5, and in this process, adjustment can be carried out on the respective LEDAs 132 arranged in the main-scanning direction as illustrated in FIG. 5 sequentially from an end thereof.

For example, for the first LEDA 132 arranged at the end, only adjustment of the range in the main-scanning direction of the exposure spots of the respective LED element rows is first carried out as described with reference to FIG. 12. In this process, since the positions of the exposure spots of the respective LED element rows need not be shifted in the main-scanning direction, adjustment is carried out so that the peak of the cumulative exposure energy is positioned at the center of the range in the main-scanning direction in which six LED elements 132*a* are arranged, for example.

Next, for the second LEDA 132, adjustment of sparseness and closeness of the interval between the second LEDA 132 and the first LEDA 132 that is already adjusted is carried out at the same time as adjustment of the range in the main-scanning direction of the exposure spots of the respective LED element rows. Thus, the number of LED elements 132*a* whose light quantities are to be increased for adjustment of the range in the main-scanning direction of the exposure spots of the respective LED element rows is selected, and the LED elements 132*a* whose light quantities are to be increased for adjustment of the range in the main-scanning direction of the exposure spots of the respective LED element rows are selected from the six LED elements 132*a*.

Figure 17A:
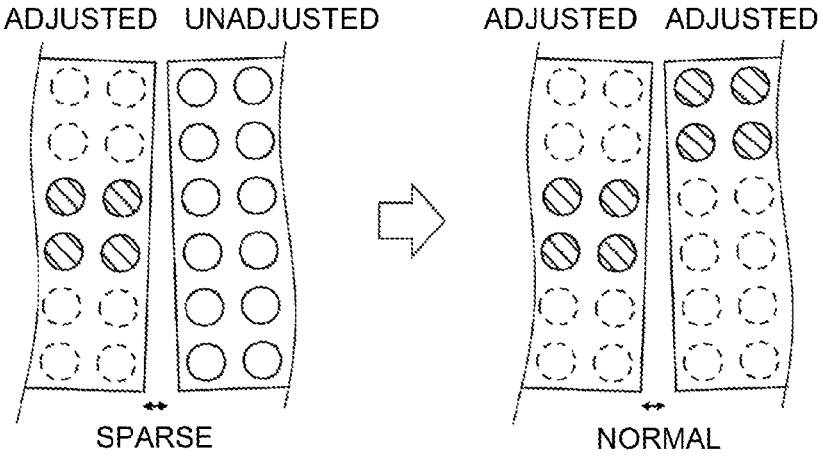
FIGS. 17A to 17C are diagrams illustrating a mode of adjustment of the LEDA attachment error and adjustment of the intervals between LEDAs according to the embodiment of the present invention.
Figure 17B:
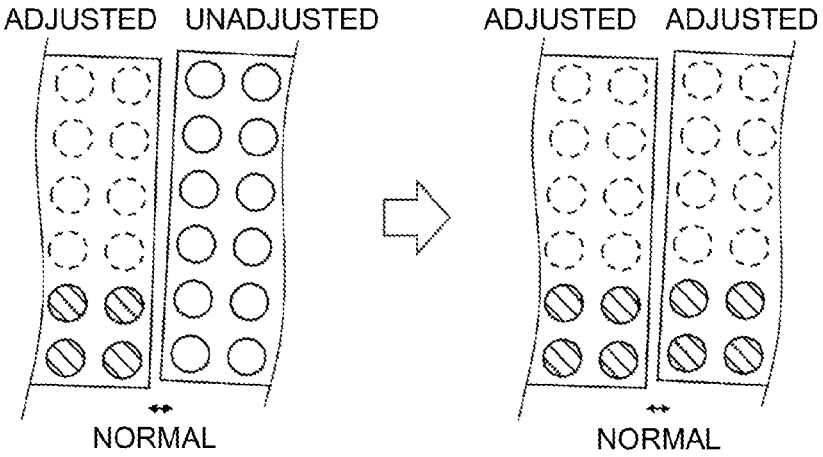
Figure 17C:
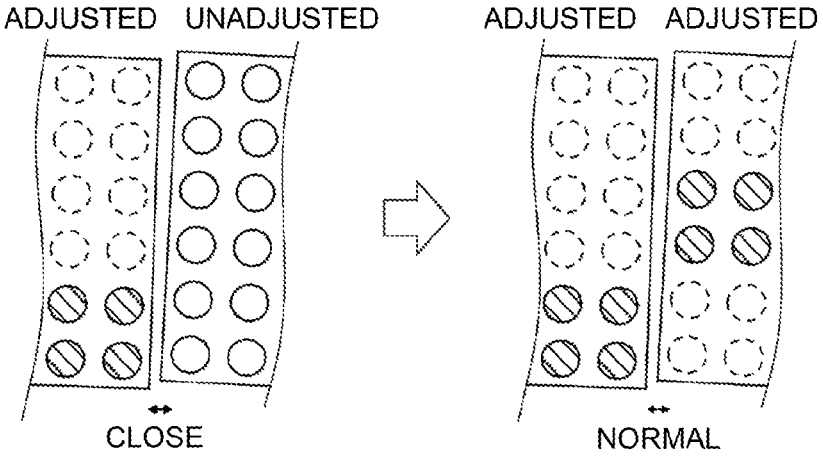

Subsequently, similarly for the third and subsequent LEDAs 132, adjustment of sparseness and closeness of the intervals between the LEDAs 132 and the first LEDA 132 that is already adjusted is carried out at the same time as adjustment of the range in the main-scanning direction of the exposure spots of the respective LED element rows. FIGS. 17A to 17C are diagrams illustrating such a mode.

FIGS. 17A to 17C each illustrate adjacent parts of two LEDAs 132, in which an LEDA 132 for which an emission amount adjustment value is determined (hereinafter referred to as "adjusted") is illustrated on the left and an unadjusted LEDA 132 to be adjusted next is illustrated on the right. In the case of FIG. 17A, the LED elements 132*a* whose light quantities are increased as a result of light quantity adjustment of the LED element rows included in the adjusted LEDA 132 are the two LED elements 132*a* at the center among the six arranged LED elements 132*a*. Furthermore, as illustrated on the left of an arrow, the space between the adjusted LEDA 132 and the unadjusted LEDA 132 is in a sparse state.

Thus, in adjustment of the LED elements 132*a* included in the unadjusted LEDA 132, the light quantities of two LED elements 132*a* among the six LED elements 132*a* are increased and the light quantities of the other LED elements 132*a* are decreased to adjust the range in the main-scanning direction of the exposure spots of the respective LED element rows.

In this process, the LED elements 132*a* whose light quantities are to be increased are the upper LED elements 132*a* in FIG. 17A, that is, the LED elements 132*a* close to the adjusted LEDA 132 in the range in the main-scanning direction in which the respective LED elements 132*a* are arranged. As a result, the peak position of the exposure spots of the LED element rows included in the right LEDA 132 can be shifted to the left in the main-scanning direction so that the space between the two LEDAs 132 becomes a normal space.

In the case of FIG. 17B, as illustrated on the left of the arrow, the LED elements 132*a* whose light quantities are increased as a result of light quantity adjustment of the LED element rows included in the adjusted LEDA 132 are the lower two LED elements 132*a* in FIG. 17B among the six arranged LED elements 132*a*. Furthermore, the space between the adjusted LEDA 132 and the unadjusted LEDA 132 is in a normal state.

Thus, in adjustment of the LED elements 132*a* included in the unadjusted LEDA 132, adjustment of the main-scanning positions of exposure spots of the respective LED element rows should be normally unnecessary. As a result of the adjustment of the adjusted LEDA 132, however, the light quantities of the lower two LED elements 132*a* in FIG. 17B are increased, and as a result, the main-scanning positions of the exposure spots of the LED element rows included in the adjusted LEDA 132 are shifted in the direction away from the unadjusted LEDA 132.

Thus, in the adjustment of the LED elements 132*a* included in the unadjusted LEDA 132, the LED elements 132*a* whose light quantities are to be increased are the lower LED elements 132*a* in FIG. 17B, that is, the LED elements 132*a* close to the adjusted LEDA 132 in the range in the main-scanning direction in which the respective LED elements 132*a* are arranged.

As a result, the peak position of the exposure spots of the LED element rows included in the right LEDA 132 can be shifted to the left in the main-scanning direction on the basis of the exposure spots of the LED element rows shifted to the left in the main-scanning direction in the adjusted LEDA 132 so that the space between the two LEDAs 132 can be kept at the normal space.

In the case of FIG. 17C, as illustrated on the left of the arrow, the LED elements 132*a* whose light quantities are increased as a result of light quantity adjustment of the LED element rows included in the adjusted LEDA 132 are the lower two LED elements 132*a* in FIG. 17C among the six arranged LED elements 132*a*. Thus, the main-scanning positions of the exposure spots of the LED element rows included in the adjusted LEDA 132 are adjusted in the direction away from the unadjusted LEDA 132.

Thus, the space between the adjusted LEDA 132 and the unadjusted LEDA 132 that was in a close state is already adjusted as a result of the adjustment in the adjusted LEDA 132.

In the adjustment of the LED elements 132*a* included in the unadjusted LEDA 132, the LED elements 132*a* whose light quantities are to be increased are the two LED elements 132*a* at the center among the six arranged LED elements, that is, a mode in which the positions of the exposure spots in the main-scanning direction are not adjusted is used. As a result, the space between the two LEDAs 132 becomes the normal space as a result of the adjustment of the adjusted LEDA 132.

Figure 18A:
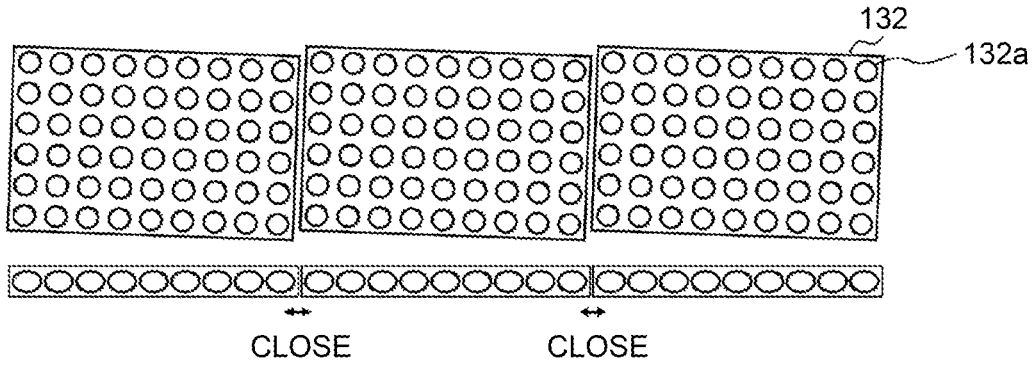
FIGS. 18A to 18C are diagrams illustrating a mode of adjustment of the LEDA attachment error and adjustment of the intervals between LEDAs according to the embodiment of the present invention.

Next, a mode of carrying out adjustment in view of the entirety in sequentially adjusting the light quantities of the LED elements for each LEDA 132 as described with reference to FIGS. 17A to 17C will be described with reference to FIGS. 18A to 18C. A state in which the LEDAs 132 are partially closely arranged as illustrated in FIG. 18A may occur depending on arrangement of the LEDAs 132 in a LEDA print head 130 as described with reference to FIG. 5.

Figure 18B:
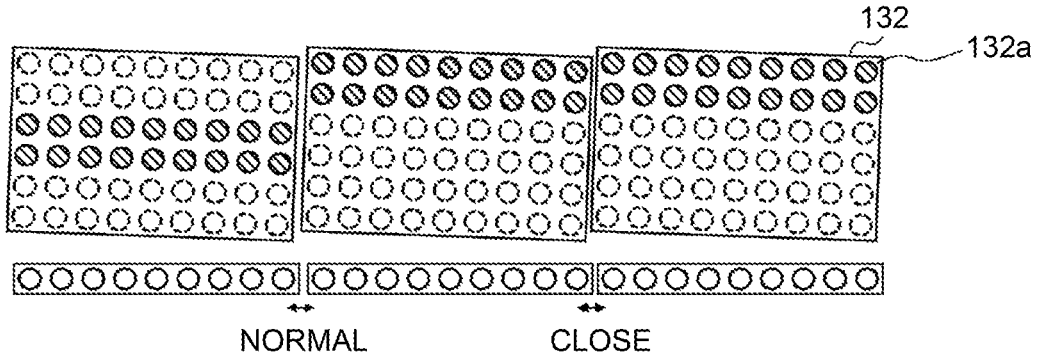

In such a case, assume a case in which the light quantities of two LED elements 132*a* at the center among six LED elements 132*a* are increased as a result of adjustment of the light quantities of the LED element rows included in the LEDA 132 on the left in FIG. 18B as illustrated in FIG. 18B. In this case, since the space between the arrays that in a close state is adjusted in adjustment of the light quantities of the LED element rows included in the central LEDA 132, the adjustment is carried out so that the exposure spots are shifted in the direction away from the left LEDA 132.

Thus, as illustrated in FIG. 18B, the light quantities of the upper two LED element rows in FIG. 18B are increased among the LED element rows included in the central LEDA 132. Specifically, in the range in the main-scanning direction in which six LED elements 132*a* are arranged, two LED elements 132*a* whose light quantities are to be increased are selected so that the exposure spots are shifted in the direction away from the left LEDA 132. As a result, the space between the left LEDA 132 and the central LEDA 132 is adjusted from the close state to the normal state.

Next, since the space between the right LEDA 132 and the central LEDA 132 that is in a close state is adjusted in adjustment of the light quantities of the LED element rows included in the right LEDA 132, the adjustment needs to be carried out so that the exposure spots are shifted in the direction away from the left LEDA 132. The positions of the exposure spots of the LED element rows in the central LEDA 132 are, however, shifted to the right as a result of the adjustment described above.

Thus, in adjustment of the light quantities of the LED element rows included in the right LEDA 132, adjustment based on the result of adjusting the central LEDA 132 needs to be carried out in addition to adjustment of the space between arrays that is originally in a close state, but the adjustable range is one end to the other of the six arranged LED elements 132*a* and further adjustment cannot be carried out. As a result, the space between the central LEDA 132 and the right LEDA 132 remains in the close state as illustrated in FIG. 18B.

Figure 18C:
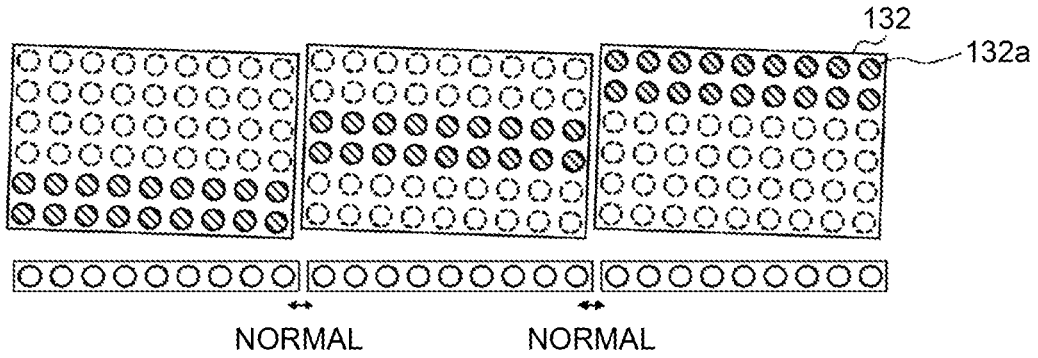

In contrast, in adjustment of the exposure spots of the LED element rows included in the left LEDA 132 in FIG. 18C, a mode of adjusting the light quantities of two lower LED elements in FIG. 18C among the six arranged LED elements can be considered as illustrated in FIG. 18C. With such a mode, the spaces between the three LEDAs 132 can be adjusted to the normal state as illustrated in FIG. 18C.

Next, the content of correction data stored in the correction data storage unit 137 of each LEDA print head 130 and details of correction operation according to the present embodiment will be described. FIGS. 19A and 19B are tables illustrating the content of the correction data stored in the correction data storage unit 137. FIG. 19A is a table illustrating information (hereinafter referred to as "misalignment information") relating to misalignment and tilt of each of the LEDA print head 130, the LEDAs 132 included therein, and the LED elements 132*a* included therein, and FIG. 19B is a table illustrating variation (hereinafter referred to as "light quantity variation information") in the light quantities of the respective LED elements 132*a*.

As illustrated in FIG. 19A, in the misalignment information according to the present embodiment, an "element number" identifying each of the LED elements 132*a* included in each of the LEDAs 132 is associated with the amount of misalignment from a reference position of the LED elements 132*a* in each of the LEDAs 132 as "element misalignment amount." Note that each element misalignment amount according to the present embodiment is associated with misalignment amounts in the main-scanning direction and the sub-scanning direction in such a form as "$X_{11}$, $Y_{11}$."

Furthermore, the "element number" according to the present embodiment is a number in such a form as "#1-1," "#1-2," . . . , "#2-1," "#2-2" that identifies the LEDA 132 by the first numeral and identifies the LED element in the LEDA 132 by the second numeral. In addition, the misalignment amount from the reference position of each LEDA 132 and the tilt as described with reference to FIG. 10B are associated as a "chip misalignment amount." Note that each chip misalignment amount according to the present embodiment is associated with misalignment amounts in the main-scanning direction and the sub-scanning direction in such a form as "$X_{\#1}$, $Y_{\#1}$," and with the tilt in such a form as "$\theta_{\#1}$."

In addition, a misalignment amount of each of the LEDA print heads 130 arranged in the optical writing device 111 as illustrated in FIG. 4 from a reference position and a tilt as described with reference to FIG. 10A are associated as an "entire misalignment amount." Note that the entire misalignment amount according to the present embodiment is associated with misalignment amounts in the main-scanning direction and the sub-scanning direction in such a form as "$X_0$, $Y_0$," and with the tilt in such a form as "$\theta_0$."

As illustrated in FIG. 19B, in the light quantity variation information according to the present embodiment, an "element number" identifying each of the LED elements 132*a* included in each of the LEDAs 132 is associated with "reference light quantity" that is a light quantity when each LED element is driven with a reference drive current.

Furthermore, the "element number" according to the present embodiment is a number in such a form as "#1-1," "#1-2," . . . , "#2-1," "#2-2" that identifies the LEDA 132 by the first numeral and identifies the LED element in the LEDA 132 by the second numeral. In addition, an average value of the reference light quantities of the LED elements included in each LEDA 132 is associated as an "array average light quantity" for each array. In addition, the light quantity variation information contains an "entire average light quantity" representing the average intensity of each of the LEDA print heads 130 arranged in the optical writing device 111 as illustrated in FIG. 4.

Next, operation of adjusting the light quantity of each of the LED element rows included in each LEDA 132 according to the present embodiment will be described with reference to a flowchart of FIG. 20. The timing for performing the operation illustrated in FIG. 20 is after drawing a correction pattern on the conveyance belt 105, carrying out misalignment correction operation of correcting misregistration of an image by reading the correction pattern, and calculating a skew correction amount for correcting skew of the resulting image, for example.

Figure 20:
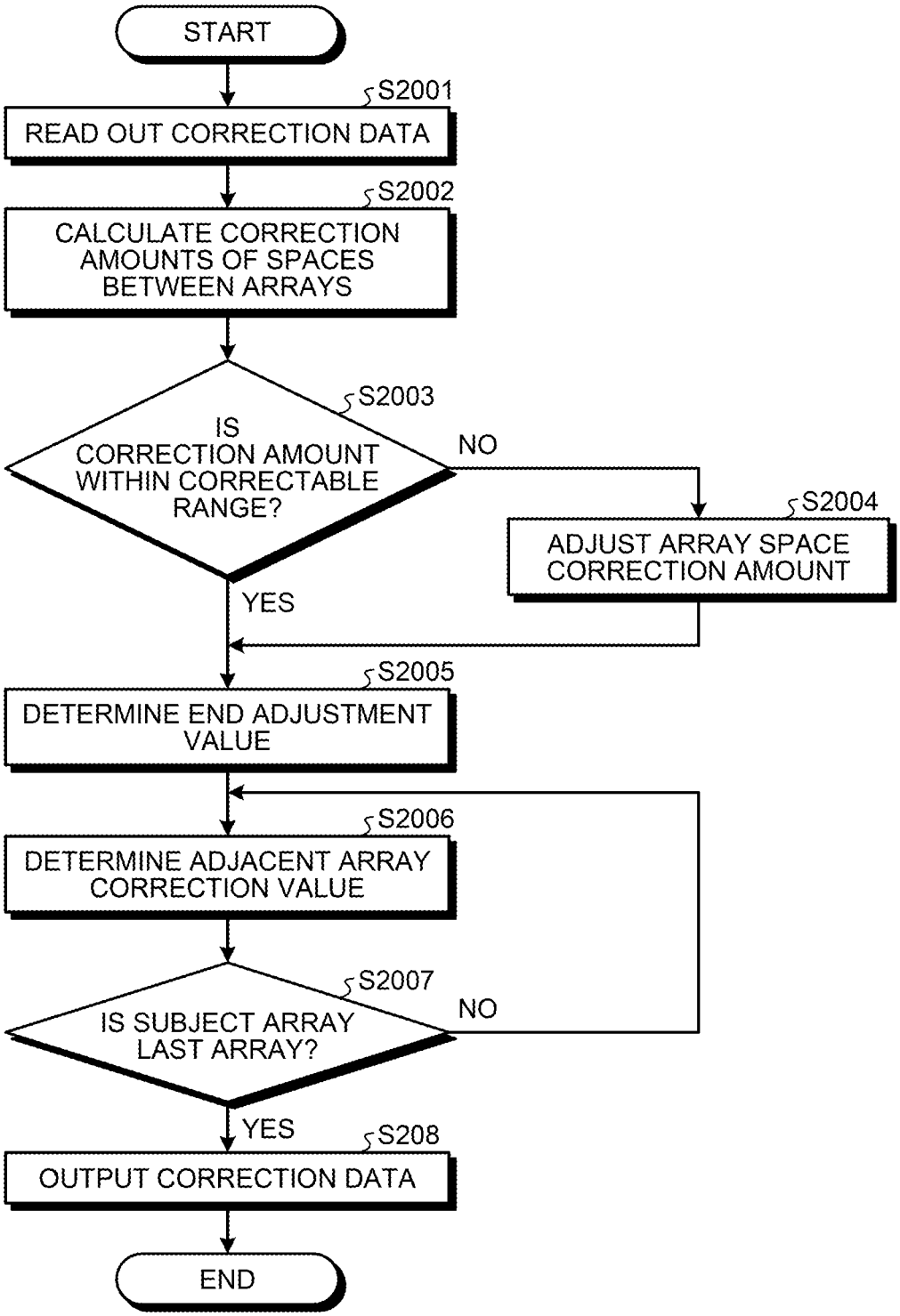
FIG. 20 is a flowchart illustrating operation of generating correction data according to the embodiment of the present invention.

As illustrated in FIG. 20, the correction data acquisition unit 305 first reads out correction data from the correction data storage unit 137 of the LEDA print head 130 (S2001). The correction data processing unit 306 refers to the correction data read by the correction data acquisition unit 305, and first calculates the correction amounts of the spaces between the LEDAs 132 as described with reference to FIG. 14 (S2002).

In S2002, the correction data processing unit 306 refers to the "chip misalignment amount" of and the "element misalignment amount" of a LED element row arranged at an end of each LEDA 132 in the misalignment information described with reference to FIG. 19A, and determines the spaces between the arrays on the basis of the misalignment amount from the reference position of each LEDA 132 and the misalignment amount from the reference position of the LED element 132*a* arranged at the end.

The spaces between arrays herein do not simply refer to the spaces between LEDAs 132 but refers to spaces between LED element rows arranged at ends of the respective LEDAs 132, that is, the spaces between pixels at joints of the LEDAs 132. Adjustment values for adjusting the spaces between arrays are then calculated on the basis of the tilt angle $\theta_{\#n}$ of each of the LEDAs 132 contained in the "chip misalignment amount."

Here, adjustable positions of the exposure spots of the LED element rows when a LED element row is constituted by six LED elements 132*a* arranged in the sub-scanning direction as in the present embodiment will be described with reference to FIG. 21. As described above, in the present embodiment, the LEDs 132 whose light quantities are to be increased and the LED elements 132*a* whose light quantities are to be decreased are selected from among six arranged LED elements 132*a* to adjust the main-scanning positions of the exposure spots on the basis of the tilt of the LEDA 132 with respect to the sub-scanning direction.

Specifically, the adjustable range and units are determined depending on the arrangement of six LED elements 132*a*. FIG. 21 illustrate cases (a) to (f) in which exposure spots are set with the center at the position of each of the LED elements 132*a*, and are represented by 1 to 6 corresponding to each of the six LED elements 132*a*.

Figure 21:
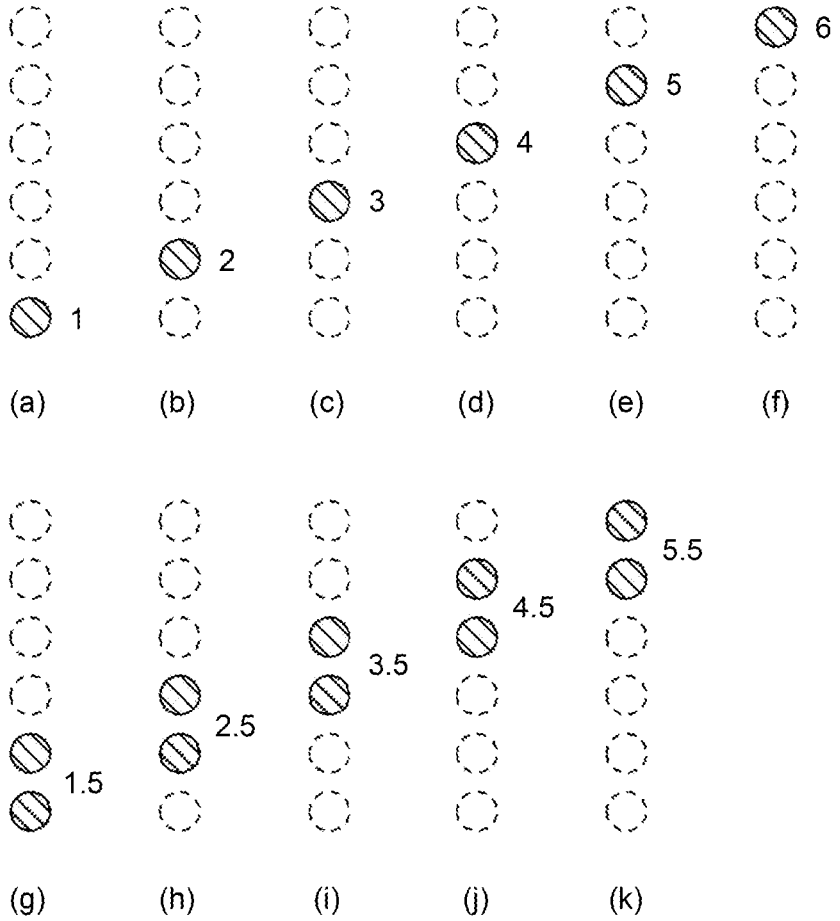
FIG. 21 is a diagram illustrating examples of a peak element position according to the embodiment of the present invention.

FIG. 21 illustrate cases (g) to (k) in which exposure spots are set with the center at the position between the LED elements 132*a*, and are represented by 1.5, 2.5, . . . , and 5.5 corresponding to between the six LED elements 132*a*. Specifically, when a LED element row is constituted by six LED elements 132*a*, up to a change of ±5 from 1 to 6 or from 6 to 1 is possible. The smallest unit of the change is 0.5.

When the positions of exposure spots of the respective LED element rows are changed as illustrated in cases (a) to (k) in FIG. 21, the amount of shift of the exposure spots in the main-scanning direction varies depending on the tilt amounts of the respective LEDAs 132 and the tilt amounts of the LEDA print heads 130. Thus, in S2002, the correction data processing unit 306 determines the shift amount of light emitting positions of the LED elements 132*a* necessary for correcting the spaces between arrays, that is, a value from 1 to 5 in units of 0.5 as illustrated in cases (a) to (k) in FIG. 21 on the basis of the misalignment amount and the tilt amount of each of the LEDAs 132 and the tilt amount of the LEDA print head 130.

Figure 22:
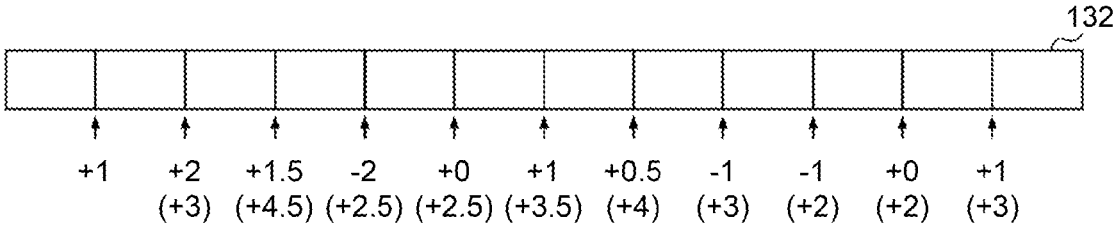
FIG. 22 is a diagram illustrating examples of a shift amount of the peak element position calculated for correcting the spaces between arrays according to the embodiment of the present invention.

FIG. 22 is a diagram illustrating the shift amount of the light emitting positions of the LED elements 132*a* determined for correcting the spaces between arrays as determined as described above. In other words, the numerical values presented in FIG. 22 are adjustment amounts necessary for adjusting the spaces between LED element rows included in each of adjacent LEDAs 132 among the LEDAs 132 constituting the LEDA print head 130.

FIG. 22 illustrates how much the position (hereinafter referred to as a "peak element position") of an LED element whose light quantity needs to be increased needs to be shifted on the basis of the values described with reference to cases (a) to (k) in FIG. 21 for determining the light quantities of the LED element rows of the LEDA 132 adjacent on the right on the basis of the leftmost LEDA 132 as a reference.

For adjusting the space between the first LEDA 132 at the left end and the second LEDA 132, the peak element position of the second LEDA 132 needs to be changed by +1, for example. Note that the up direction is positive and the down direction is negative in FIG. 22 according to cases (a) to (k) illustrated in FIG. 21.

Thus, when the peak element position of the first LEDA 132 illustrated in FIG. 22 is in the state illustrated in case (a) in FIG. 21, the peak element position of the second LEDA 132 is in the state illustrated in case (b) in FIG. 21. Alternatively, when the peak element position of the first LEDA 132 is in the state illustrated in case (h) in FIG. 21, the peak element position of the second LEDA 132 is in the state illustrated in case (I) in FIG. 21.

The values in brackets in FIG. 22 are values representing cumulative totals of the shift amounts of the peak element position sequentially from the left taking the signs into consideration. As described above, the maximum change amount of the peak element position is ±5. Thus, when the absolute value of a value in brackets is larger than 5, correction cannot be carried out. Even when the absolute value of a value in brackets is within 5, if the total of the absolute value of a positive value and the absolute value of a negative value is larger than 5, correction cannot be carried out since adjustment practically larger than 5 will be required.

Thus, the correction data processing unit 306 checks the value in the brackets illustrated in FIG. 22 to check whether or not the total of the absolute value of a positive value and the absolute value of a negative value exceeds 5, that is, whether or not the total value is within a correctable range (S2003). Although the determination is made on whether or not the total value exceeds 5 since a LED element row is constituted by six LED elements in the present embodiment, the specific determination varies depending on the number of LED elements constituting a LED element row.

If it is determined that correction cannot be carried out, that is, the total value exceeds 5 as a result of the determination of S2003 (S2003/NO), the correction data processing unit 306 adjusts the array space correction value presented in FIG. 22 (S2004). Details of the processing in S2004 will be described later.

If it is determined that correction can be carried out, that is, the total value is within 5 as a result of the determination of S2003 (S2003/YES) or if the processing in S2004 is completed, the correction data processing unit 306 determines the adjustment value of the LEDA 132 arranged at the end (S2005). The LEDA 132 arranged at the end is the first LEDA 132 to start the process of setting exposure spots of the LED element rows in each LEDA 132.

In S2005, the correction data processing unit 306 obtains a tilt amount of a LED element row with respect to the sub-scanning direction on the basis of the tilt amount of the subject LEDA 132 at the end and the tilt amount of the LEDA print head 130, and determines the number of LED elements 132*a* whose light quantities are to be increased on the basis of the obtained result as described with reference to FIG. 12.

Figure 23:
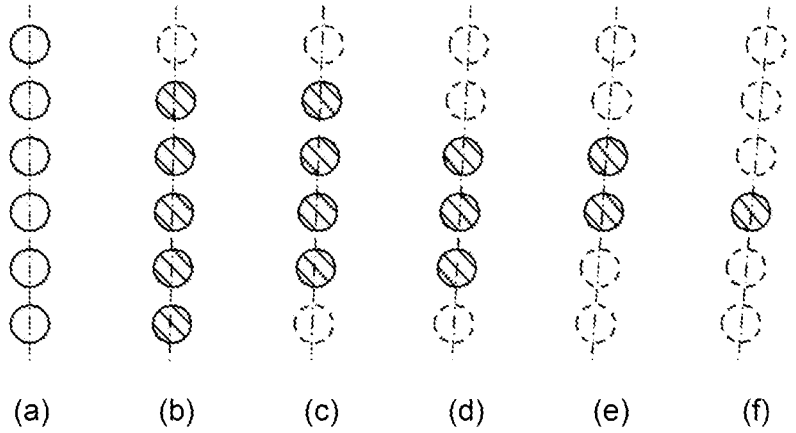
FIG. 23 is a diagram illustrating examples of the number of emissions of the LED elements depending on the tilt of the LED element row with respect to the conveyance direction according to the embodiment of the present invention.

Specifically, in S2005, the correction data processing unit 306 functions as an error information acquisition unit that acquires information indicating an error of the direction in which the LED elements 132*a* are arranged in the LED element row with respect to the sub-scanning direction. FIG. 23 is a diagram illustrating examples of the number of LED elements 132*a* whose light quantities are to be increased depending on the tilt amount of the LED element row with respect to the sub-scanning direction.

As illustrated in state (a) in FIG. 23, when the LED element row is not tilted with respect to the sub-scanning direction, the number of LED elements 132*a* whose light quantities are to be increased for adjusting the exposure spot positions need not be adjusted. FIG. 23 illustrate states (a) to (f) in which the tilt of the LED element row with respect to the conveyance direction becomes gradually larger. As illustrated in states (a) to (f) in FIG. 23, the width of the exposure spots in the main-scanning direction can be adjusted by adjusting the number of LED elements 132*a* whose light quantities are to be increased depending on the tilt amount.

Note that, as the number of the LED elements 132*a* whose light quantities are to be increased is larger, the adjustable range of the peak element position becomes narrower. In the example illustrated in state (b) in FIG. 23, for example, the peak element positions are the center positions of five LED elements 132*a*, but the adjustable range of the peak element position is only either of the two central LED elements 132*a* of the six LED elements.

Thus, even if the number of LED elements 132*a* whose light quantities are to be increased for adjusting the width of exposure spots in the main-scanning direction need not be reduced, the number of LED elements 132*a* whose light quantities are to be increased may be reduced to ensure the adjustable range of the peak element position.

In S2005, after determining the number of LED elements 132*a* whose light quantities are to be increased, the correction data processing unit 306 then determines the peak element position on the basis of the values in brackets calculated as illustrated in FIG. 22. In the example of FIG. 22, for example, the maximum value of the values in brackets is "+4." Thus, since at least four peak element positions needs to be shifted in the positive direction, adjustment becomes impossible if the peak element position in the LEDA 132 at the end is upper than that in the state illustrated in case (b) in FIG. 21.

Thus, in the example illustrated in FIG. 22, the correction data processing unit 306 selects any of 1, 1.5, and 2 as the peak element position of the LEDA 132 at the end. In this case, it is preferable to select a value that is as close as possible to 3.5 that is the center of the peak element positions in order to suppress variation in the peak element position in the main-scanning direction of the entire LEDA print head 130 as much as possible.

Although cases in which the values in brackets are only positive values are illustrated in FIG. 22, the absolute value of a positive value and the absolute value of the negative value need to be referred to for determining the correctable range as described above. In S2005, the correction data processing unit 306 thus refers to the maximum absolute value of the positive value and the maximum absolute value of the negative value of the values in brackets to determine the peak element position of the LEDA 132 arranged at the end. Such a process is a process of making the entire correction range correctable as described with reference to FIG. 18C.

Subsequently, the correction data processing unit 306 determines the light quantities of the LED elements in the LED element rows included in adjacent LEDA 132 and the peak element position as described with reference to FIGS. 17A to 17C (S2006). In S2006, the correction data processing unit 306 determines the peak element position on the basis of the correction values of the spaces between arrays calculated as illustrated in FIG. 22, and determines the number of LED elements whose light quantities are to be increased on the basis of the tilts of the LED element rows included in the subject LEDA 132 with respect to the sub-scanning direction.

The correction data processing unit 306 sequentially repeats the processing of S2006 for adjacent LEDAs 132 (S2007/NO), and when the determination of the correction value for the LEDA 132 at the other end, that is, the last array is completed (S2007/YES), outputs the calculated correction values to the correction data setting unit 136 (S2008) and terminates the processing.

Next, the processing in S2004 according to the present embodiment will be described. As described above, the processing in S2004 is a process in which, when a change value of the peak element position for correcting the spaces between arrays is calculated as illustrated in FIG. 22 and the correction is determined to be impossible, the change value of the peak element position of the arrays is adjusted.

Figure 24:
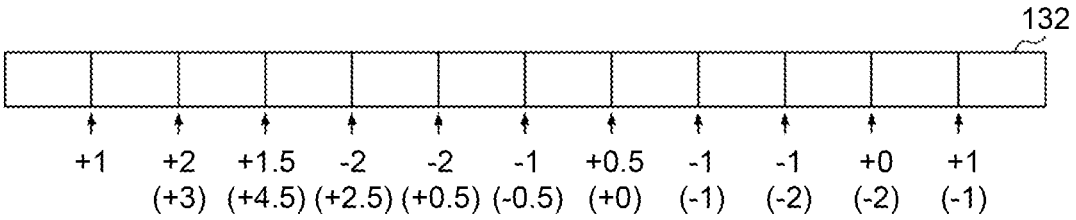
FIG. 24 is a diagram illustrating examples of the shift amount of the peak element position calculated for correcting the spaces between arrays according to the embodiment of the present invention.

FIG. 24 is a diagram illustrating a result of calculating the change value of the peak element position for correcting spaces between arrays when adjustment cannot be carried out. In the case of FIG. 24, the maximum absolute value of the positive value is "4.5" and the maximum absolute value of the negative value is "2." Thus, the total is 6.5 that exceeds 5, and adjustment is therefore impossible. This value of 6.5 is referred to as a required adjustment value.

In S2004, the correction data processing unit 306 adjusts the change value of the peak element position calculated for each space between arrays so that the aforementioned required adjustment value becomes within 5. Specifically, the adjustment value $P'_{adj(\#n)}$ is calculated by the following Expression (1) on the basis of the change value $P_{adj(\#n)}$ of the peak element position of each spaces between arrays. In the expression, $P_{adj(\#n)}$ represents a change value of the peak element position between an n-th LEDA 132 and an n+1-th LEDA 132, N represents the number of LED elements 132*a* included in a LED element row, and $P_{MAX}$ represents the aforementioned required adjustment value.

$$P'_{adj(\#n)} = P_{adj(\#n)} \times \frac{(N-1)}{P_{MAX}} \tag{1}$$

Figure 25:
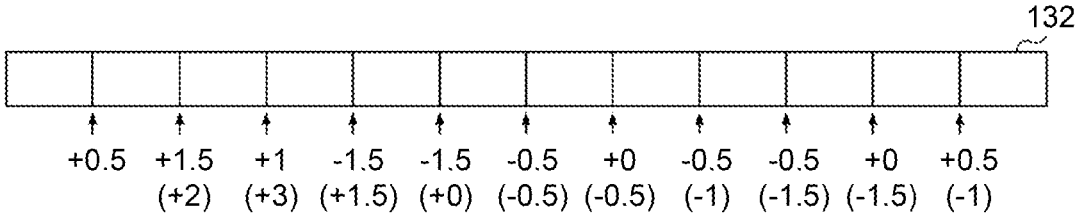
FIG. 25 is a diagram illustrating examples of the shift amount of the peak element position calculated for correcting the spaces between arrays according to the embodiment of the present invention.

The meaning of the expression (1) corresponds to dividing the value of (N−1) that is an adjustment range that is adjustable in the entirety among the spaces between arrays according to the adjustment values $P_{adj(\#n)}$ required for respective spaces between arrays. FIG. 25 is a diagram illustrating the adjustment values $P'_{adj(\#n)}$ of the change value of the peak element position after the correction as described above. In FIG. 25, values are in units of 0.5 and are rounded off in units of 0.5.

Figures 26, 27:
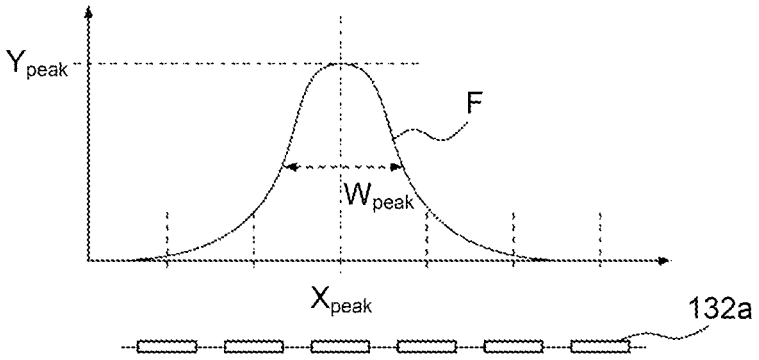
FIG. 26 is a graph illustrating a mode of adjusting the light quantities of the LED elements according to the embodiment of the present invention.
FIG. 27 is a table illustrating a mode of adjusting the light quantities of the LED elements according to the embodiment of the present invention.

Next, a specific method for adjusting the light quantities of the LED elements will be described. FIG. 26 is a graph illustrating an example in which a function F is used to determine the light quantities of the respective LED elements 132*a* included in a LED element row. The function F illustrated in FIG. 26 is a function defined by $X_{peak}$ representing the peak element position as described above and $Y_{peak}$ representing the light quantity at the peak element position, and a peak width $W_{peak}$ corresponding to the number of LED elements 132*a* whose light quantities are to be increased as described with reference to FIG. 23 as parameters.

In S2005 and S2006, the correction data processing unit 306 sets the function F on the basis of $X_{peak}$, $Y_{peak}$, and $W_{peak}$ described above, and assigns the value of X representing the position of each LED element 132*a* in the function F to obtain the light quantity of each of the LED elements 132*a*. Alternatively, multiple functions F may be provided depending on the tilt of the LED element row with respect to the conveyance direction instead of using the peak width $W_{peak}$ as a parameter.

FIG. 27 is a diagram illustrating an example in which a table (hereinafter referred to as a "light quantity adjustment value table") in which the light quantities of the respective LED elements 132*a* are set in advance to determine the light quantities of the respective LED elements 132*a* included in the LED element row. As illustrated in FIG. 27, the light quantity adjustment values of six light emitting elements are set in advance in the light quantity adjustment value table using $X_{peak}$ and $Y_{peak}$ as parameters.

The correction data processing unit 306 selects a row with the closest values of $X_{peak}$ and $Y_{peak}$ and determines the light quantities of the respective LED elements 132*a*. In the mode of FIG. 27, multiple light quantity adjustment value tables are generated in advance depending on the tilts of the LED element rows with respect to the conveyance direction, and the correction data processing unit 306 selects a table according to the tilt of the LED element row with respect to the conveyance direction and determines the light quantities of the respective LED elements 132*a*.

According to the mode described with reference to FIGS. 26 and 27, the correction data processing unit 306 determines adjustment values for adjusting the light quantities of the respective LED elements 132*a*. The correction data processing unit 306 thus functions as an adjustment value generation unit.

As described above, in the optical writing control unit 201 included in the optical writing device 111 according to the present embodiment, when the arrangement direction of multiple LED elements 132*a* arranged in the sub-scanning direction in each LED element row included in a LEDA 132 has an error with respect to the sub-scanning direction, the light quantities of the LED elements 132*a* included in each LED element row are controlled on the basis of the error. It is thus possible to suitably correct the exposure states of pixels to be drawn by the respective LED element rows and to prevent deterioration in the image quality caused by the error.

In the embodiment described above, adjustment of exposure spots of LED element rows and adjustment of the light quantities of the LED elements 132*a* for adjusting spaces between adjacent LEDAs 132 caused by attachment errors of the LEDA print heads 130 and the LEDAs 132 as described with reference to FIGS. 10A and 10B are described.

In addition, the adjustment of the light quantities of the LED elements 132*a* requires adjustment of the reference light quantities of the respective LED elements 132*a* as described with reference to FIG. 19B. The correction data processing unit 306 thus determines the final adjustment values of the light quantities on the basis of the adjustment values of the light quantities of the LED elements 132*a* determined by the operation described with reference to FIG. 20 and the adjustment values of the light quantities of the LED elements 132*a* determined on the basis of the light quantity variation information illustrated in FIG. 19B.

Note that adjustment of a strobe period and adjustment of drive current can be used for the method for adjusting the light quantities as described above. In this case, the adjustment based on the misalignment information illustrated in FIG. 19A that is an object of the present invention and the adjustment based on the light quantity variation information illustrated in FIG. 19B may be used separately. For example, the adjustment based on the misalignment information may be carried out by adjusting the strobe period, and the adjustment based on the light quantity variation information may be carried out by adjusting the drive current.

Furthermore, an example in which the LED elements 132*a* are used as the light emitting elements is described in the embodiment described above. This is, however, merely an example, and an organic electro-luminescence (EL) elements, laser diodes (LDs), or the like may be used.

Furthermore, an example in which the shift amount of the peak element position is adjusted when correction cannot be carried out as a result of calculating and accumulating the shift amounts of the peak element positions in all the LEDAs 132 as described with reference to S2004 in FIG. 20 is described in the embodiment described above. This is, however, merely an example, and an uncorrectable range may not be corrected any further as illustrated in FIG. 28B.

According to the present invention, deterioration in image quality due to attachment error of light emitting elements can be prevented when a light source in which multiple light emitting elements are arranged in the sub-scanning direction is used for an optical writing device for forming an electrostatic latent image.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An optical writing controller that controls emission of alight source device including multiple light emitting element rows each constituted by multiple light emitting elements arranged in a sub-scanning direction to form an electrostatic latent image on a photoconductor, the optical writing controller comprising:

an image information acquisition unit configured to acquire image information that is information on an image to be formed as the electrostatic latent image;

a light source control unit configured to sequentially control emission of the multiple light emitting elements arranged in the sub-scanning direction on the basis of information on pixels generated on the basis of the acquired image information;

an error information acquisition unit configured to acquire information indicating an error of a direction in which the light emitting elements are arranged with respect to the sub-scanning direction; and an adjustment value generation unit configured to generate an adjustment value for adjusting a light quantity of each of the light emitting elements on the basis of the error of the direction in which the light emitting elements are arranged with respect to the sub-scanning direction.

2. The optical writing controller according to claim 1, wherein the light source control unit sequentially controls emission of the light emitting elements so that an exposure amount at a position corresponding to each of pixels constituting the electrostatic latent image to be formed on the photoconductor is accumulated by exposure of each of the light emitting elements arranged in the sub-scanning direction.

3. The optical writing controller according to claim 2, wherein the adjustment value generation unit acquires a spread in a main-scanning direction of arrangement positions of the light emitting elements caused by a tilt of the direction in which the light emitting elements are arranged with respect to the sub-scanning direction on the basis of the information indicating the error, and generates the adjustment value so that a spread in the main-scanning direction of distribution of the exposure amount accumulated by the light emitting elements is adjusted on the basis of the spread in the main-scanning direction of the arrangement positions of the light emitting elements.

4. The optical writing controller according to claim 3, wherein the adjustment value generation unit generates the adjustment value so that the light quantities of a predetermined number of light emitting elements among the multiple light emitting elements included in the light emitting element row are increased and the light quantities of the other light emitting elements are decreased so as to adjust the spread in the main-scanning direction of the distribution of the exposure amount accumulated by the light emitting elements.

5. The optical writing controller according to claim 2, wherein the light source device includes multiple light emitting element arrays arranged in the main-scanning direction, the light emitting element arrays each including multiple light emitting element rows arranged in the main-scanning direction;

the error information acquisition unit acquires information indicating misalignment of the arrangement of the light emitting element arrays in the light source device; and the adjustment value generation unit acquires a space between the light emitting element arrays arranged adjacent to each other on the basis of the information indicating misalignment, and generates the adjustment value so that the position in the main scanning direction of the distribution of the exposure amount of each of the light emitting elements on the basis of the space between the light emitting element arrays arranged adjacent to each other.

6. The optical writing controller according to claim 5, wherein the adjustment value generation unit generates the adjustment value so that the light quantities of light emitting elements at predetermined positions among the multiple light emitting elements included in the light emitting element row are increased and the light quantities of the other light emitting elements are decreased so as to adjust the position in the main-scanning direction of the distribution of the exposure amount accumulated by the light emitting elements.

7. The optical writing controller according to claim 6, wherein the adjustment value generation unit acquires an adjustment value of the position of the distribution necessary for adjusting the space between the light emitting element arrays sequentially from a light emitting element array arranged at an end among the light emitting element arrays arranged in the main-scanning direction on the basis of the space between the light emitting element arrays arranged adjacent to each other, acquires the spread in the main-scanning direction of the arrangement positions of the light emitting elements caused by a tilt of the direction in which the light emitting elements are arranged with respect to the sub-scanning direction on the basis of the information indicating the error, and generates the adjustment value so that the spread and the position of the distribution in the main-scanning direction of the exposure amount of each of the light emitting elements in the light emitting element array arranged at the end on the basis of the spread in the main-scanning direction of the arrangement positions of the light emitting elements and the adjustment amount of the position of the distribution.

8. The optical writing controller according to claim 7, wherein the adjustment value generation unit acquires a range in which the position of the distribution is adjustable on the basis of the number of light emitting elements included in the light emitting element array, and corrects the adjustment amount of the position of the distribution on the basis of a ratio of the adjustable range of the position of the distribution and the adjustment amount of the position of the distribution when the adjustment amount of the position of the distribution acquired for all the light emitting element arrays exceeds the adjustable range of the position of the distribution.

9. An image forming apparatus comprising the optical writing controller according to claim 1.

10. An optical writing control method for acquiring image information that is information on an image to be formed as an electrostatic latent image on a photoconductor, and controlling emission of a light source device including multiple light emitting element rows each constituted by multiple light emitting elements arranged in a sub-scanning direction on the basis of information on pixels generated on the basis of the acquired image information to form the electrostatic latent image on the photoconductor, the optical writing control method comprising:

acquiring information indicating an error of a direction in which the light emitting elements are arranged with respect to the sub-scanning direction;

generating an adjustment value for adjusting a light quantity of each of the light emitting elements on the basis of the error of the direction in which the light emitting elements are arranged with respect to the sub-scanning direction; and controlling emission of the light source device with a light quantity adjusted by the adjustment value.

* * * * *